US012595718B2

(12) United States Patent
Muller

(10) Patent No.: US 12,595,718 B2
(45) Date of Patent: Apr. 7, 2026

(54) HAZARDOUS WASTE CANISTER SYSTEMS AND METHODS

(71) Applicant: Deep Isolation, Inc., Berkeley, CA (US)

(72) Inventor: Richard A. Muller, Berkeley, CA (US)

(73) Assignee: Deep Isolation, Inc., Berkeley, CA (US)

( * ) Notice: Subject to any disclaimer, the term of this patent is extended or adjusted under 35 U.S.C. 154(b) by 308 days.

(21) Appl. No.: 18/272,295

(22) PCT Filed: Feb. 14, 2022

(86) PCT No.: PCT/US2022/016344
§ 371 (c)(1),
(2) Date: Jul. 13, 2023

(87) PCT Pub. No.: WO2022/177862
PCT Pub. Date: Aug. 25, 2022

(65) Prior Publication Data

US 2024/0309732 A1 Sep. 19, 2024

Related U.S. Application Data

(60) Provisional application No. 63/209,184, filed on Jun. 10, 2021, provisional application No. 63/162,819, filed on Mar. 18, 2021, provisional application No. 63/149,729, filed on Feb. 16, 2021.

(51) Int. Cl.
*E21B 41/00* (2006.01)

(52) U.S. Cl.
CPC ..... *E21B 41/005* (2013.01)

(58) Field of Classification Search
USPC ..... 250/506.1
See application file for complete search history.

(56) References Cited

U.S. PATENT DOCUMENTS

| | | | |
|---|---|---|---|
| 2,861,636 | A | 11/1958 | Messenger |
| 3,379,013 | A | 4/1968 | Slagle et al. |
| 3,711,715 | A | 1/1973 | Bochard |
| 3,780,309 | A | 12/1973 | Bochard |

(Continued)

FOREIGN PATENT DOCUMENTS

| | | |
|---|---|---|
| CN | 1973339 A | 5/2007 |
| CN | 101124640 | 2/2008 |

(Continued)

OTHER PUBLICATIONS

[No Author] "Yucca Mountain cost estimate rises to $96 billion," World Nuclear News, Aug. 6, 2008, 2 pages.

(Continued)

*Primary Examiner* — Kiet T Nguyen
(74) *Attorney, Agent, or Firm* — Fish & Richardson P.C.

(57) ABSTRACT

A hazardous waste canister includes a housing that defines an inner volume sized to enclose a portion of hazardous waste and including an excess space between the enclosed portion of hazardous waste and an inner wall surface of the housing; a cap configured to seal an open end of the housing through which the portion of hazardous waste is inserted into the inner volume; and a pressure balancing material inserted into the inner volume to fill the excess space.

26 Claims, 7 Drawing Sheets

(56) References Cited

U.S. PATENT DOCUMENTS 3,899,631 A 8/1975 Clark
3,902,548 A 9/1975 Bochard
3,930,166 A 12/1975 Bochard
3,948,575 A 4/1976 Rosser
4,057,108 A 11/1977 Broussard
4,274,007 A 6/1981 Baatz et al.
4,320,028 A 3/1982 Leuchtag
4,337,167 A 6/1982 Bird et al.
4,625,122 A 11/1986 Botzem et al.
4,708,522 A 11/1987 Bergman et al.
4,886,393 A 12/1989 Jahn-Held et al.
5,133,624 A 7/1992 Cahill
5,165,235 A 11/1992 Nitschke
5,199,488 A 4/1993 Kasevich et al.
5,202,522 A 4/1993 Williams
5,284,996 A 2/1994 Vickers
5,314,264 A 5/1994 Danko et al.
5,318,382 A 6/1994 Cahill
5,340,235 A 8/1994 Milliken
5,377,104 A 12/1994 Sorrells et al.
5,387,741 A 2/1995 Shuttle
5,464,988 A 11/1995 Rossmasssler et al.
5,489,739 A 2/1996 Curry et al.
5,589,603 A 12/1996 Alexander et al.
5,785,133 A 7/1998 Murray et al.
5,786,611 A 7/1998 Quapp et al.
5,832,392 A 11/1998 Forsberg
5,835,548 A 11/1998 Lindgren et al.
5,850,614 A 12/1998 Crichlow
5,863,283 A 1/1999 Gardes
5,868,210 A 2/1999 Johnson et al.
5,920,602 A 7/1999 Botzem et al.
6,002,063 A 12/1999 Bilak et al.
6,114,710 A 9/2000 Contrepois et al.
6,186,428 B1 * 2/2001 Robinson ..... B02C 19/186 241/73
6,238,138 B1 5/2001 Crichlow
6,366,633 B1 4/2002 Stezaly et al.
6,372,157 B1 4/2002 Krill et al.
6,784,443 B2 8/2004 Pennington et al.
6,853,697 B2 2/2005 Singh et al.
6,889,108 B2 5/2005 Tanaka et al.
6,925,138 B2 8/2005 Nakamaru et al.
7,068,748 B2 6/2006 Singh
7,287,934 B2 10/2007 Okutsu et al.
7,330,526 B2 2/2008 Singh
7,590,213 B1 9/2009 Singh
7,676,016 B2 3/2010 Singh
7,781,637 B2 8/2010 Russell et al.
7,786,456 B2 8/2010 Singh et al.
7,933,374 B2 4/2011 Singh
8,003,966 B2 8/2011 Temus et al.
8,098,790 B2 1/2012 Singh
8,135,107 B2 3/2012 Singh et al.
8,342,357 B1 1/2013 Grubb et al.
8,351,562 B2 1/2013 Singh
8,437,444 B2 5/2013 Pennington et al.
8,561,318 B2 10/2013 Singh et al.
8,576,976 B2 11/2013 Singh et al.
8,625,732 B2 1/2014 Singh
8,630,384 B2 1/2014 Carver et al.
8,657,549 B2 2/2014 Grubb et al.
8,737,559 B2 5/2014 Singh
8,798,224 B2 8/2014 Singh
8,929,504 B2 1/2015 Singh et al.
8,933,289 B2 1/2015 Crichlow
9,349,493 B2 5/2016 Bracey et al.
9,396,824 B2 7/2016 Agace
9,442,037 B2 9/2016 Agace
9,443,625 B2 9/2016 Singh
9,514,853 B2 12/2016 Singh et al.
9,558,857 B2 1/2017 Subiry
9,640,289 B2 5/2017 Springman et al.
9,672,948 B2 6/2017 Singh
9,724,790 B2 8/2017 Grubb et al.
9,748,009 B2 8/2017 Singh
9,761,338 B2 9/2017 Singh
9,779,843 B2 10/2017 Singh et al.
9,831,005 B2 11/2017 Singh
9,833,819 B2 12/2017 Burget
9,852,822 B2 12/2017 Singh
9,916,911 B2 3/2018 Singh
10,002,683 B2 6/2018 Muller et al.
10,008,299 B2 6/2018 Wellwood et al.
10,020,084 B2 7/2018 Lehnert et al.
10,032,533 B2 7/2018 Carver et al.
10,037,826 B2 7/2018 Singh et al.
10,049,777 B2 8/2018 Singh
10,115,490 B1 10/2018 Downey
10,147,509 B2 12/2018 Singh
10,217,537 B2 2/2019 Agace
10,229,764 B2 3/2019 Singh et al.
10,265,743 B1 4/2019 Muller et al.
10,297,356 B2 5/2019 Springman et al.
10,300,512 B2 5/2019 Muller et al.
10,311,987 B2 6/2019 Singh et al.
10,315,238 B1 6/2019 Muller et al.
10,332,642 B2 6/2019 Singh
10,373,722 B2 8/2019 Singh
10,410,756 B2 9/2019 Singh
10,438,710 B2 10/2019 Subiry
10,446,287 B2 10/2019 Singh
10,614,927 B2 4/2020 Muller et al.
10,692,618 B2 6/2020 Muller
10,861,614 B2 12/2020 Muller et al.
10,926,306 B2 2/2021 Muller et al.
11,135,629 B2 10/2021 Muller et al.
11,158,434 B2 10/2021 Payer et al.
11,338,337 B2 5/2022 Muller et al.
11,666,953 B2 6/2023 Muller et al.
2001/0032851 A1 10/2001 Pennington et al.
2002/0020528 A1 2/2002 McCabe et al.
2004/0109523 A1 6/2004 Singh et al.
2005/0117687 A1 6/2005 Carver et al.
2005/0207525 A1 9/2005 Singh
2005/0220257 A1 10/2005 Singh
2006/0215803 A1 9/2006 Singh
2008/0039673 A1 2/2008 Maksimov
2008/0069291 A1 3/2008 Singh et al.
2008/0073601 A1 3/2008 Temus et al.
2008/0308271 A1 12/2008 Chouzenoux et al.
2009/0135986 A1 5/2009 Georgii
2009/0158614 A1 6/2009 Singh et al.
2009/0159550 A1 6/2009 Singh et al.
2009/0252274 A1 10/2009 Singh
2010/0105975 A1 4/2010 Baird
2010/0225107 A1 9/2010 Tverlid
2010/0234663 A1 9/2010 Crichlow
2010/0254785 A1 10/2010 Grubb et al.
2010/0272225 A1 10/2010 Singh
2010/0284506 A1 11/2010 Singh
2011/0005762 A1 1/2011 Poole
2011/0021859 A1 1/2011 Singh
2011/0054234 A1 3/2011 Georgii
2011/0255647 A1 10/2011 Singh
2012/0083644 A1 4/2012 Singh
2013/0070885 A1 3/2013 Singh et al.
2013/0112408 A1 5/2013 Oxtoby
2013/0163710 A1 6/2013 Singh
2013/0322589 A1 12/2013 Bracey et al.
2013/0340225 A1 12/2013 Grubb et al.
2014/0034875 A1 2/2014 Nakarai et al.
2014/0039235 A1 2/2014 Subiry
2014/0047733 A1 2/2014 Singh et al.
2014/0177776 A1 6/2014 Singh
2014/0192946 A1 7/2014 Singh
2014/0219408 A1 8/2014 Singh
2014/0221722 A1 8/2014 Germanovich et al.
2014/0270043 A1 9/2014 Lehnert et al.
2014/0317952 A1 10/2014 Singh
2014/0329455 A1 11/2014 Singh
2014/0341330 A1 11/2014 Singh
2015/0069274 A1 3/2015 Agace
2015/0071398 A1 3/2015 Singh

(56) References Cited

U.S. PATENT DOCUMENTS

| | | | | |
|---|---|---|---|---|
| 2015/0092904 | A1 | 4/2015 | Carver et al. | |
| 2015/0211954 | A1 | 7/2015 | Agace | |
| 2015/0340112 | A1 | 11/2015 | Singh et al. | |
| 2015/0357066 | A1 | 12/2015 | Singh | |
| 2016/0027538 | A1 | 1/2016 | Singh et al. | |
| 2016/0047785 | A1* | 2/2016 | Mann | G01N 33/0055 73/23.2 |
| 2016/0118152 | A1 | 4/2016 | Singh et al. | |
| 2016/0163404 | A9 | 6/2016 | Singh | |
| 2016/0196887 | A1 | 7/2016 | Singh et al. | |
| 2016/0203884 | A1 | 7/2016 | Springman et al. | |
| 2016/0258226 | A1 | 9/2016 | Clemens et al. | |
| 2016/0365163 | A1 | 12/2016 | Singh | |
| 2017/0110209 | A1 | 4/2017 | Subiry | |
| 2017/0110210 | A1 | 4/2017 | Singh | |
| 2017/0186505 | A1 | 6/2017 | Muller et al. | |
| 2017/0236605 | A1 | 8/2017 | Springman et al. | |
| 2017/0301425 | A1 | 10/2017 | Wellwood et al. | |
| 2018/0005717 | A1 | 1/2018 | Singh et al. | |
| 2018/0005718 | A1 | 1/2018 | Singh | |
| 2018/0025800 | A1 | 1/2018 | Singh | |
| 2018/0053574 | A1 | 2/2018 | Singh | |
| 2018/0061515 | A1 | 3/2018 | Singh | |
| 2018/0144841 | A1 | 5/2018 | Singh | |
| 2018/0182504 | A1 | 6/2018 | Muller et al. | |
| 2018/0190401 | A1 | 7/2018 | Singh | |
| 2018/0277273 | A1 | 9/2018 | Singh et al. | |
| 2018/0290188 | A1 | 10/2018 | Crichlow | |
| 2018/0301231 | A1 | 10/2018 | Singh et al. | |
| 2018/0308594 | A1 | 10/2018 | Carver et al. | |
| 2018/0322970 | A1 | 11/2018 | Singh et al. | |
| 2018/0345336 | A1 | 12/2018 | Muller et al. | |
| 2019/0066858 | A1 | 2/2019 | Sisley et al. | |
| 2019/0099790 | A1 | 4/2019 | Muller et al. | |
| 2019/0103197 | A1 | 4/2019 | Singh et al. | |
| 2019/0139661 | A1 | 5/2019 | Singh | |
| 2019/0295735 | A1 | 9/2019 | Crichlow | |
| 2019/0318838 | A1 | 10/2019 | Muller et al. | |
| 2019/0326028 | A1 | 10/2019 | Singh | |
| 2019/0348186 | A1 | 11/2019 | Singh | |
| 2020/0023416 | A1 | 1/2020 | Muller et al. | |
| 2020/0027607 | A1 | 1/2020 | Muller | |
| 2020/0194140 | A1 | 6/2020 | Payer et al. | |
| 2020/0211727 | A1 | 7/2020 | Muller et al. | |
| 2020/0357532 | A1 | 11/2020 | Muller | |
| 2021/0276057 | A1 | 9/2021 | Muller et al. | |
| 2022/0080481 | A1 | 3/2022 | Muller et al. | |
| 2022/0157482 | A1 | 5/2022 | Finsterle et al. | |
| 2022/0402004 | A1 | 12/2022 | Muller et al. | |

FOREIGN PATENT DOCUMENTS

| | | | |
|---|---|---|---|
| CN | 101971268 | | 2/2011 |
| CN | 106782735 | | 5/2017 |
| EP | 2555203 | | 2/2013 |
| GB | 2104713 | | 3/1983 |
| GB | 2151839 | | 7/1985 |
| GB | 2161015 | | 1/1986 |
| JP | S58042945 | | 3/1983 |
| JP | H09264992 | | 10/1997 |
| JP | 11-271493 | A | 10/1999 |
| JP | 2000231000 | | 8/2000 |
| JP | 2001141885 | | 5/2001 |
| JP | 2001337196 | | 12/2001 |
| JP | 2003028991 | | 1/2003 |
| JP | 2004011708 | | 1/2004 |
| JP | 2005091070 | | 4/2005 |
| JP | 2005245261 | | 9/2005 |
| JP | 2006035068 | | 2/2006 |
| JP | 2006170690 | | 6/2006 |
| JP | 4902877 | | 1/2012 |
| JP | 2018-205110 | A | 12/2018 |
| KR | 10-2006701 | B1 | 8/2019 |
| TW | I484502 | | 5/2015 |
| WO | WO 1981001055 | | 4/1981 |
| WO | WO 1992007667 | | 5/1992 |
| WO | WO 2008032018 | | 3/2008 |
| WO | WO 2010007305 | | 1/2010 |
| WO | WO 2015069300 | | 5/2015 |
| WO | WO 2016177876 | | 11/2016 |
| WO | WO 2017112479 | | 6/2017 |

OTHER PUBLICATIONS

Arnold, et al., "Reference Design and Operations of Deep Borehole Disposal of High-Level Radioactive Waste," SAND2011-6749, Sandia National Laboratories, 2011, 67 pages.

Buscheck et al., "Thermohydrologic behavior at an underground nuclear waste repository," Water Resources Research, Mar. 2002, 38(3):1-19.

Chapman and Hooper, "The disposal of radioactive wastes underground," Proceedings of the Geologists Association, 2012, 123(1):46-63.

Cornwall, "Deep Sleep. Boreholes drilled into Earth's crust get a fresh look for nuclear waste disposal," Science, Jul. 10, 2015, 349(6244):132-35.

Dozier, "Feasibility of Very Deep Borehole Disposal of US Nuclear Defense Wastes," Thesis for the degree of Master of Science in Nuclear Science and Engineering, Massachusetts Institute of Technology, Sep. 2011, 176 pages.

Faybishenko et al., Editors, Lawrence Berkeley National Laboratory and Sandia National Laboratories: "International Approaches for Deep Geological Disposal of Nuclear Waste: Geological Challenges in Radioactive Waste Isolation," prepared for the US Department of Energy, Fifth Worldwide Review—2016, 474 pages.

Gibb et al., "A Model for Heat Flow in Deep Borehole Disposals of High-Level Nuclear Waste," J. Geophysical Research, May 6, 2008, 113, 18 pages.

Gibbs, "Feasibility of Lateral Emplacement in Very Deep Borehole Disposal of High Level Nuclear Waste," Thesis for the degrees of Naval Engineering and Nuclear Engineering, Massachusetts Institute of Technology, Jun. 2010, 154 pages.

Haukwa et al., "Modeling thermal-hydrological response of the unsaturated zone at Yucca Mountain, Nevada, to thermal load at a potential repository," Journal of Contaminant Hydrology, 2003, (62-63):529-552.

Hoag, "Canister Design for Deep Borehole Disposal of Nuclear Waste," Thesis for the degree of Master of Science in Nuclear Science and Engineering, Massachusetts Institute of Technology, May 2006, 125 pages.

Hurd, "Choosing and Using a Form Release Agent," Concrete Construction, 1996, 41(10):732-736.

International Preliminary Report on Patentability in International Application No. PCT/US2022/016344 mailed on Aug. 31, 2023, 8 pages.

International Search Report and Written Opinion in International Application No. PCT/US2022/016344 mailed on Jun. 10, 2022, 11 pages.

King et al., "Copper corrosion under expected conditions in a deep geological repository," Swedish Nuclear Fuel and Waste Management Co., SKB Technical Report TR-01-23, Jan. 1, 2001, 171 pages.

Neuzil et al., "Shale: An overlooked option for US nuclear waste disposal," Bulletin of the Atomic Scientists, Nov. 27, 2014, retrieved on Sep. 26, 2016, retrieved from URL: <http://thebulletin .org/shale-overlooked-option-us-nuclear-waste-disposal7831>, 5 pages.

Neuzil, "Can Shale Safely Host U.S. Nuclear Waste?" EOS, Jul. 23, 2013, 94(30), 3 pages.

ScientificAmerican.com [online], "Why doesn't stainless steel rust?" Mar. 12, 2001, retrieved on Mar. 13, 2024, retrieved from URL: <https://www.scientificamerican.com/article/why-doesnt-stainless-stee/>, 3 pages.

Sone and Zoback, "Mechanical properties of shale-gas reservoir rocks—Part 1:Static and dynamic elastic properties and anisotropy," Geophysics, Sep.-Oct. 2013, 78(5):D381-392.

Thomson, "Performance Confirmation Concepts Study Report," Civilian Radioactive Waste Management System Management & Operating Contractor TRW, Nov. 22, 1996, 331 pages.

(56) References Cited

OTHER PUBLICATIONS

U.S. Nuclear Waste Technical Review Board, "A Report to the U.S. Congress and the Secretary of Energy, Evaluation of Technical Issues Associated With the Development of a Separate Repository for U.S. Department of Energy-Managed High-Level Radioactive Waste and Spent Nuclear Fuel," Jun. 2015 (available at: http://www.nwtrb.gov/reports/disposal_options.pdf), 30 pages.
United States Department of Energy, "Executive Summary—Environmental Impact Statement, Waste Isolation Pilot Plant (WIPP)," Oct. 1980, 1544 pages.
United States Department of Energy, "Quality Assurance Program Document, DOE/CBFO-94-1012 Revision 13," Carlsbad Field Office, Apr. 20, 2017, 127 pages.
United States Department of Energy, "Safety Evaluation Report Addendum for Annual Update of Waste Isolation Plant, Document Safety Analysis, Revision 6, and Technical Safety Requirements, Revision 6," dated Feb. 26, 2018, 55 pages.
United States Department of Energy, "Safety Evaluation Report for Approval of DOE/WIPP 07-3372, Waste Isolation Plant Documented Safety Analysis, Revision 5 and DOE/WIPP 07-3373, Waste Isolation Pilot Plant Technical Safety Requirements, Revision 5," dated Apr. 29, 2016, 235 pages.
United States Department of Energy, "Waste Isolation Pilot Plant, Environmental Monitoring Plan, Revision 10," dated Jun. 22, 2017, 56 pages.
United States Department of Energy, "Waste Isolation Plant, Documented Safety Analysis," Nuclear Waste Partnership LLC Carlsbad, NM, dated Feb. 2018, 777 pages.
United States Department of Energy, "Waste Isolation Plant, Final Supplement, Environmental Impact Statement," dated Jan. 1990, 1498 pages.
United States Department of Energy, "Waste Isolation Plant, Final Technical Safety Requirements," Nuclear Waste Partnership LLC Carlsbad, NM, dated Feb. 2018, 291 pages.
Vartabedian, "Decades-old war over Yucca Mountain nuclear dump resumes under Trump budget plan," Mar. 29, 2017, ralph.vartabdian@latimes.com; twitter @rvartabedian, 4 pages.
Verma et al., "Temperature-dependent thermophysical properties of Ganurgarh shales from Bhander group, India." Environmental Earth Sciences, Feb. 2016, 75(300):1-11.
Winterle et al., "Regulatory Perspectives on Deep Borehole Disposal Concepts," prepared for the U.S. Nuclear Regulatory Commission, Contract NRC-02-07006, Center for Nuclear Waste Regulatory Analyses, San Antonio, TX, May 2011, 24 pages.
Yang et al., "Modeling transient heat transfer in nuclear waste repositories," Journal of Hazardous Materials, 2009 169(1-3):108-112.
YuccaMountain.org [online]; "Eureka County, Nevada—Nuclear Waste Office, FAQ's," last updated Mar. 17, 2017, retrieved from URL: <https://www.yuccamountain.org/faq.htm>, 12 pages.

* cited by examiner

HAZARDOUS WASTE CANISTER SYSTEMS AND METHODS

CROSS REFERENCE TO RELATED APPLICATIONS

This application is a National Stage of International Application No. PCT/US2022/016344, filed on Feb. 14, 2022, which claims the benefit of U.S. Provisional Patent Application Ser. Nos. 63/149,729, filed on Feb. 16, 2021; 63/162,819, filed on Mar. 18, 2021; and 63/209,184, filed on Jun. 10, 2021. The contents of the PCT and prior applications referenced above are incorporated herein by reference in their entireties.

TECHNICAL FIELD

This disclosure relates to storing hazardous waste in a subterranean formation and, more particularly, storing hazardous waste in one or more hazardous waste canisters that is emplaced in a drillhole.

BACKGROUND

Hazardous waste is often placed in long-term, permanent, or semi-permanent storage so as to prevent health issues among a population living near the stored waste. Such hazardous waste storage is often challenging, for example, in terms of storage location identification and surety of containment. For instance, the safe storage of nuclear waste (e.g., spent nuclear fuel, whether from commercial power reactors, test reactors, or even high-grade military waste) is considered to be one of the outstanding challenges of energy technology. Safe storage of the long-lived radioactive waste is a major impediment to the adoption of nuclear power in the United States and around the world. Conventional waste storage methods have emphasized the use of tunnels, and is exemplified by the design of the Yucca Mountain storage facility. Other techniques include boreholes, including vertical boreholes, drilled into crystalline basement rock. Other conventional techniques include forming a tunnel with boreholes emanating from the walls of the tunnel in shallow formations to allow human access.

SUMMARY

In an example implementation, a hazardous waste canister includes a housing that defines an inner volume sized to enclose a portion of hazardous waste and including an excess space between the enclosed portion of hazardous waste and an inner wall surface of the housing; a cap configured to seal an open end of the housing through which the portion of hazardous waste is inserted into the inner volume; and a pressure balancing material inserted into the inner volume to fill the excess space.

In an aspect combinable with the example implementation, the pressure balancing material is configured to exert a pressure on the inner wall surface of the housing to balance a pressure exerted by an underground fluid in a subterranean formation on an outer wall surface of the housing.

In another aspect combinable with any of the previous aspects, the pressure balancing material is configured to exert a pressure on the inner wall surface of the housing that is about equal to a pressure exerted by an underground fluid in a subterranean formation on an outer wall surface of the housing.

In another aspect combinable with any of the previous aspects, the pressure balancing material is configured to exert a pressure on the inner wall surface of the housing that is about equal to a pressure exerted by an underground fluid in a subterranean formation at a depth of at least 1500 meters on an outer wall surface of the housing.

In another aspect combinable with any of the previous aspects, the pressure balancing material includes a gas.

In another aspect combinable with any of the previous aspects, the pressurized gas includes one or more inert gasses.

In another aspect combinable with any of the previous aspects, the pressurized gas is at a pressure of about 2200 psi.

In another aspect combinable with any of the previous aspects, the pressure balancing material includes a liquid.

In another aspect combinable with any of the previous aspects, the liquid is pumped into the inner volume.

In another aspect combinable with any of the previous aspects, the liquid is pre-heated to a desired temperature prior to being inserted into the inner volume to fill the excess space.

In another aspect combinable with any of the previous aspects, the liquid is pre-cooled to a desired temperature prior to being inserted into the inner volume to fill the excess space.

In another aspect combinable with any of the previous aspects, the liquid includes water or a molten salt.

In another aspect combinable with any of the previous aspects, the pressure balancing material includes a solid.

In another aspect combinable with any of the previous aspects, the solid includes a granular or particulate solid.

In another aspect combinable with any of the previous aspects, the granular or particulate solid includes sand.

In another aspect combinable with any of the previous aspects, the pressure balancing material includes a solidifiable liquid.

In another aspect combinable with any of the previous aspects, the solidifiable liquid is in a solid form when inserted into the inner volume to fill the excess space.

In another aspect combinable with any of the previous aspects, the solidifiable liquid is in a liquid form in the excess space based on at least one of a temperature in the inner volume or a time duration subsequent to insertion of the solid form into the inner volume to fill the excess space.

In another aspect combinable with any of the previous aspects, the solidifiable liquid includes a fusible alloy.

In another aspect combinable with any of the previous aspects, the fusible alloy includes solder.

In another aspect combinable with any of the previous aspects, the solidifiable liquid includes at least one of an epoxy resin, an acrylic resins, a benzoxazines, a vinyl ester, a thermosetting resin, or gallium with a low melting point.

In another aspect combinable with any of the previous aspects, the hazardous waste includes nuclear or radioactive waste.

In another aspect combinable with any of the previous aspects, the nuclear or radioactive waste includes at least a portion of a spent nuclear fuel assembly.

In another example implementation, a method includes enclosing a portion of hazardous waste in an inner volume of a housing of a hazardous waste canister that includes an excess space between the enclosed portion of hazardous waste and an inner wall surface of the housing; inserting a pressure balancing material into the inner volume to fill the excess space; and sealing an open end of the housing through which the portion of hazardous waste is inserted into the inner volume with a cap.

In an aspect combinable with the example implementation, the pressure balancing material is configured to exert a pressure on the inner wall surface of the housing to balance a pressure exerted by an underground fluid in a subterranean formation on an outer wall surface of the housing.

In another aspect combinable with any of the previous aspects, the pressure balancing material is configured to exert a pressure on the inner wall surface of the housing that is about equal to a pressure exerted by an underground fluid in a subterranean formation on an outer wall surface of the housing.

In another aspect combinable with any of the previous aspects, the pressure balancing material is configured to exert a pressure on the inner wall surface of the housing that is about equal to a pressure exerted by an underground fluid in a subterranean formation at a depth of at least 1500 meters on an outer wall surface of the housing.

In another aspect combinable with any of the previous aspects, the pressure balancing material includes a gas.

In another aspect combinable with any of the previous aspects, the pressurized gas includes one or more inert gasses.

In another aspect combinable with any of the previous aspects, the pressurized gas is at a pressure of about 2200 psi.

In another aspect combinable with any of the previous aspects, the pressure balancing material includes a liquid.

In another aspect combinable with any of the previous aspects, the liquid is pumped into the inner volume.

In another aspect combinable with any of the previous aspects, the liquid is pre-heated to a desired temperature prior to being inserted into the inner volume to fill the excess space.

In another aspect combinable with any of the previous aspects, the liquid is adjusted to the proper temperature to a desired temperature prior to being inserted into the inner volume to fill the excess space.

In another aspect combinable with any of the previous aspects, the liquid includes water or a molten salt.

In another aspect combinable with any of the previous aspects, the pressure balancing material includes a solid.

In another aspect combinable with any of the previous aspects, the solid includes a granular or particulate solid.

In another aspect combinable with any of the previous aspects, the granular or particulate solid includes sand.

In another aspect combinable with any of the previous aspects, the pressure balancing material includes a solidifiable liquid.

In another aspect combinable with any of the previous aspects, the solidifiable liquid is in a solid form when inserted into the inner volume to fill the excess space.

In another aspect combinable with any of the previous aspects, the solidifiable liquid is in a liquid form in the excess space based on at least one of a temperature in the inner volume or a time duration subsequent to insertion of the solid form into the inner volume to fill the excess space.

In another aspect combinable with any of the previous aspects, the solidifiable liquid includes a fusible alloy.

In another aspect combinable with any of the previous aspects, the fusible alloy includes solder.

In another aspect combinable with any of the previous aspects, the solidifiable liquid includes at least one of an epoxy resin, an acrylic resins, a benzoxazines, a vinyl ester, a thermosetting resin, or low temperature gallium.

In another aspect combinable with any of the previous aspects, the hazardous waste includes nuclear or radioactive waste.

In another aspect combinable with any of the previous aspects, the nuclear or radioactive waste includes at least a portion of a spent nuclear fuel assembly.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
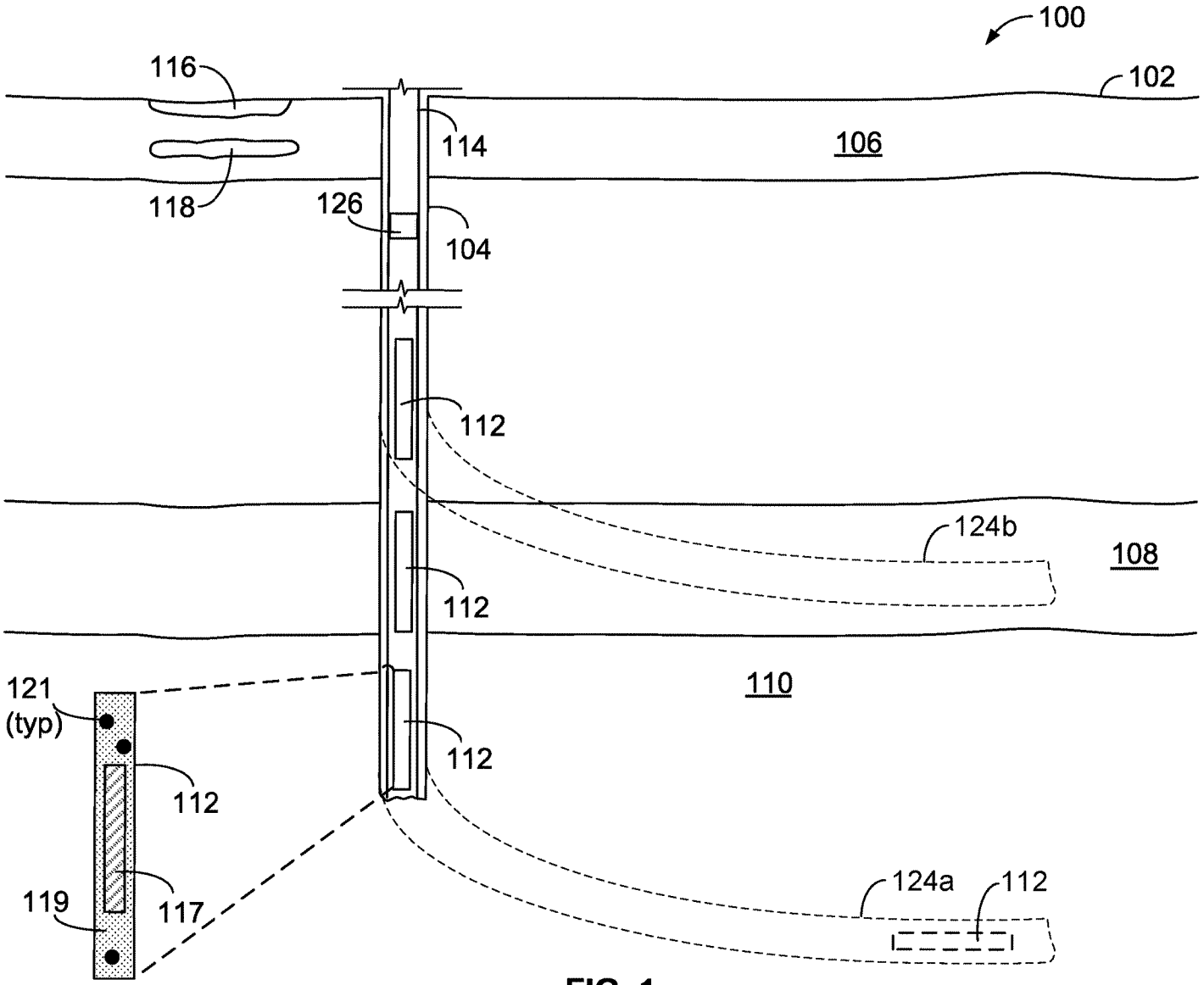
FIG. 1 is a schematic illustration of an example implementation of a hazardous waste repository with one or more hazardous waste canisters according to the present disclosure.

FIG. 1 is a schematic illustration of an example implementation of a hazardous waste repository, e.g., a subterranean location for the long-term (e.g., tens, hundreds, or thousands of years or more) but retrievable safe and secure storage of hazardous waste enclosed in a hazardous waste canister according to the present disclosure. For example, turning to FIG. 1, this figure illustrates an example hazardous waste repository 100 that is formed through one or more subterranean formations and stores (temporarily or permanently) one or more hazardous waste canisters 112. As illustrated, the hazardous waste repository 100 includes a drillhole (i.e., borehole or wellbore) 104 formed (e.g., drilled or otherwise) from a terranean surface 102 and through multiple subterranean layers 106, 108, and 110. Although the terranean surface 102 is illustrated as a land surface, terranean surface 102 may be a sub-sea or other underwater surface, such as a lake or an ocean floor or other surface under a body of water. Thus, the present disclosure contemplates that the drillhole 104 may be formed under a body of water from a drilling location on or proximate the body of water.

The illustrated drillhole 104 is a vertical or substantially (e.g., accounting for drilling imperfections) vertical drillhole in this example of hazardous waste repository 100. As used in the present disclosure, "substantially" in the context of a drillhole orientation, refers to drillholes that may not be exactly vertical (e.g., exactly perpendicular to the terranean surface 102) or exactly horizontal (e.g., exactly parallel to the terranean surface 102), or exactly inclined at a particular incline angle relative to the terranean surface 102. In other words, vertical drillholes often undulate offset from a true vertical direction, that they might be drilled at an angle that deviates from true vertical, and inclined drillholes often undulate offset from a true incline angle. Further, in some aspects, an inclined drillhole may not have or exhibit an exactly uniform incline (e.g., in degrees) over a length of the drillhole. Instead, the incline of the drillhole may vary over its length (e.g., by 1-5 degrees). In this example, although the drillhole 104 is a vertical drillhole, a directional drillhole 124 can also be coupled to the drillhole 104 to form a horizontal drillhole for the repository 100.

The illustrated drillhole 104, in this example, can include a casing 114 positioned and set around the drillhole 104 from the terranean surface 102 into a particular depth in the Earth. For example, the casing 114 can represent multiple casings (strings of tubulars threaded together). In some aspects, the casing 114 can being at the surface 102 as a relatively large-diameter tubular member (or string of members) set (e.g., cemented) around the drillhole 104 in a shallow formation. As used herein, "tubular" may refer to a member that has a circular cross-section, elliptical cross-section, or other shaped cross-section. For example, in this implementation of the hazardous waste repository 100, the casing 114 extends from the terranean surface 102 through a surface layer 106. The surface layer 106, in this example, is a geologic layer comprised of one or more layered rock formations. In some aspects, the surface layer 106 in this example can include surface water sources 116 and underground water sources 118 (e.g., freshwater aquifers, salt water or brine sources), or other sources of mobile water (e.g., water that moves through a geologic formation). In some aspects, the casing 114 may isolate the drillhole 104 from such mobile water, and may also provide a hanging location for other casing strings to be installed in the drillhole 104. Further, a conductor casing that is part of the casing 114 can be used to prevent drilling fluids from escaping into the surface layer 106.

The example hazardous waste repository 100 can be used for the disposal of nuclear and other toxic waste. One or more canisters 112 that enclose hazardous waste (such as nuclear waste) are positioned into one or more sections of the drillhole 104 (and drillhole portion 124 if constructed). The canisters 112 containing the waste can be lowered in the drillhole 104 using a variety of techniques, including wireline, coiled tubing, and drill pipe.

The drillhole 104 and casing 114 may be formed with various example dimensions and at various example depths (e.g., true vertical depth, or TVD). For instance, a conductor casing (not shown) may extend down to about 120 feet TVD, with a diameter of between about 28 in. and 60 in. The casing 114 may extend down to about 2500 feet TVD, with a diameter of between about 22 in. and 48 in. Them the casing 114 may extend down to about 8000 feet TVD, with a diameter of between about 16 in. and 36 in. The foregoing dimensions are merely provided as examples and other dimensions (e.g., diameters, TVDs, lengths) are contemplated by the present disclosure. For example, diameters and TVDs may depend on the particular geological composition of one or more of the multiple subterranean layers (106, 108, 110 and others), particular drilling techniques, as well as a size, shape, or design of a hazardous material canister 112 that contains hazardous material to be deposited in the hazardous waste repository 100. In some alternative examples, the casings can be circular in cross-section, elliptical in cross-section, or some other shape.

As illustrated, the drillhole 104 extends through subterranean layers 106 and 108, and, in this example, lands in a subterranean layer 110. As discussed above, the surface layer 106 may or may not include mobile water. In this example of hazardous waste repository 100, mobile water may be water that moves through a subterranean layer (including layers 106 and 108) based on a pressure differential across all or a part of the subterranean layer. For example, the surface layer 106 may be a permeable geologic formation in which water freely moves (e.g., due to pressure differences or otherwise) within the layer. In some aspects, the surface layer 106 may be a primary source of human-consumable water in a particular geographic area. Examples of rock formations of which the surface layer 106 may be composed include porous sandstones and limestones, among other formations.

Other illustrated layers, such as the subterranean formations 108 and 110 may include immobile water as well. Immobile water, in some aspects, is water (e.g., fresh, salt, brine), that is not fit for human or animal consumption, or both. Immobile water, in some aspects, may be water that, by its motion through the layers 108 and 110 (or both), cannot reach a mobile water layer, terranean surface 102, or both, within 10,000 years or more (such as to 1,000,000 years).

In some aspects, one or both of the subterranean formations 108 and 110 is an impermeable layer. The impermeable layer, in this example, may not allow mobile water to pass through. Thus, relative to a mobile water layer, an impermeable layer may have low permeability, e.g., on the order of nanodarcy permeability. An impermeable layer may be a relatively non-ductile (i.e., brittle) geologic formation. One measure of non-ductility is brittleness, which is the ratio of compressive stress to tensile strength. In some examples, the brittleness of an impermeable layer may be between about 20 MPa and 40 MPa. Rock formations of which an impermeable layer may be composed include, for example, certain kinds of sandstone, mudstone, clay, and slate that exhibit permeability and brittleness properties as described above. In such alternative examples, an impermeable layer may be composed of an igneous rock, such as granite.

In some aspects, all or most of the canisters 112 can be emplaced within one or both of the subterranean formations 108 or 110 as storage layers. Relative to an impermeable layer or other layers, a storage layer may be thick, e.g., between about 100 and 200 feet of total vertical thickness. Thickness of a storage layer may allow for easier landing and directional drilling, thereby allowing a horizontal portions (or laterals) 124*a* and 124*b* (if used) to be readily formed within the subterranean formations 110 and 108, respectively, during construction (e.g., drilling). Further, a storage layer may also have mobile or immobile water. In addition, a storage layer may have sufficient ductility, such that a brittleness of the rock formation that comprises the layer is between about 3 MPa and 10 MPa. Examples of rock formations of which a storage layer may be composed include shale and anhydrite. Further, in some aspects, hazardous material may be stored below the storage layer, even in a permeable formation such as sandstone or limestone, if the storage layer is of sufficient geologic properties to isolate the permeable layer from a mobile water layer.

In some examples implementations of the hazardous waste repository 100, one or both of the subterranean formations 108 or 110 is composed of shale. Shale, in some examples, may have properties that fit within those described above for a storage layer. For example, shale formations may be suitable for a long-term confinement of hazardous material (e.g., in the hazardous material canisters 112), and for their isolation from a mobile water layer (e.g., aquifers) and the terranean surface 102. Shale formations may be found relatively deep in the Earth, typically 3000 feet or greater, and placed in isolation below any fresh water aquifers. Other formations may include salt or other impermeable formation layer.

Shale formations (or salt or other impermeable formation layers), for instance, may include geologic properties that enhance the long-term (e.g., thousands of years) isolation of material. Such properties, for instance, have been illustrated through the long term storage (e.g., tens of millions of years) of hydrocarbon fluids (e.g., gas, liquid, mixed phase fluid) without escape of substantial fractions of such fluids into surrounding layers (e.g., mobile water layers). Indeed, shale has been shown to hold natural gas for millions of years or more, giving it a proven capability for long-term storage of hazardous material. Example shale formations (e.g., Marcellus, Eagle Ford, Barnett, and otherwise) has stratification that contains many redundant sealing layers that have been effective in preventing movement of water, oil, and gas for millions of years, lacks mobile water, and can be expected (e.g., based on geological considerations) to seal hazardous material (e.g., fluids or solids) for thousands of years after deposit.

In some aspects, a storage layer and/or an impermeable layer may form a leakage barrier, or barrier layer to fluid leakage that may be determined, at least in part, by the evidence of the storage capacity of the layer for hydrocarbons or other fluids (e.g., carbon dioxide) for hundreds of years, thousands of years, tens of thousands of years, hundreds of thousands of years, or even millions of years. For example, a storage layer and/or impermeable layer may be defined by a time constant for leakage of the hazardous material more than 10,000 years (such as between about 10,000 years and 1,000,000 years) based on such evidence of hydrocarbon or other fluid storage.

Shale (or salt or other impermeable layer) formations may also be at a suitable depth, e.g., between 3000 and 12,000 feet TVD. Such depths are typically below ground water aquifer (e.g., surface layer 106 and/or other mobile water layers). Further, the presence of soluble elements in shale, including salt, and the absence of these same elements in aquifer layers, demonstrates a fluid isolation between shale and the aquifer layers.

Another particular quality of shale that may advantageously lend itself to hazardous material storage is its clay content, which, in some aspects, provides a measure of ductility greater than that found in other, impermeable rock formations (e.g., an impermeable layer). For example, shale may be stratified, made up of thinly alternating layers of clays (e.g., between about 20-30% clay by volume) and other minerals. Such a composition may make shale less brittle and, thus less susceptible to fracturing (e.g., naturally or otherwise) as compared to rock formations in the impermeable layer (e.g., dolomite or otherwise). For example, rock formations in an impermeable layer may have suitable permeability for the long term storage of hazardous material, but are too brittle and commonly are fractured. Thus, such formations may not have sufficient sealing qualities (as evidenced through their geologic properties) for the long term storage of hazardous material.

Each canister 112 may enclose hazardous material. Such hazardous material, in some examples, may be biological or chemical waste or other biological or chemical hazardous material. In some examples, the hazardous material may include nuclear waste material, such as: Cesium-137 and Strontium-90; spent nuclear fuel from commercial nuclear reactors; vitrified waste; fragments of melted core from nuclear accidents; calcine waste; fourth generation nuclear reactor waste; and Transuranic (or TRU) waste. For example, a gigawatt nuclear plant may produce 30 tons of spent nuclear fuel per year. The density of that fuel is typically close to 10 (10 $gm/cm^{3=10}$ kg/liter), so that the volume for a year of nuclear waste is about 3 $m^3$. Spent nuclear fuel, in the form of nuclear fuel pellets, may be taken from the reactor and not modified. Nuclear fuel pellet are solid, although they can contain and emit a variety of radioactive gases including tritium (13 year half-life), krypton-85 (10.8 year half-life), and carbon dioxide containing C-14 (5730 year half-life).

In some aspects, a storage layer should be able to contain any radioactive output (e.g., gases) within the layer, even if such output escapes the canisters 112. For example, a storage layer may be selected based on diffusion times of radioactive output through the layer. For example, a minimum diffusion time of radioactive output escaping a storage layer may be set at, for example, fifty times a half-life for any particular component of the nuclear fuel pellets. Fifty half-lives as a minimum diffusion time would reduce an amount of radioactive output by a factor of $1\times10^{-15}$. As another example, setting a minimum diffusion time to thirty half-lives would reduce an amount of radioactive output by a factor of one billion.

For example, plutonium-239 is often considered a dangerous waste product in spent nuclear fuel because of its long half-life of 24,100 years. For this isotope, 50 half-lives would be 1.2 million years. Plutonium-239 has low solubility in water, is not volatile, and as a solid. its diffusion time is exceedingly small (e.g., many millions of years) through a matrix of the rock formation that comprises a storage layer (e.g., shale or other formation). A storage layer, for example comprised of shale, may offer the capability to have such isolation times (e.g., millions of years) as shown by the geological history of containing gaseous hydrocarbons (e.g., methane and otherwise) for several million years. In contrast, in conventional nuclear material storage methods, there was a danger that some plutonium might dissolve in a layer that comprised mobile ground water upon confinement escape.

In some aspects, the drillhole 104 (including one or more laterals 124*a* and 124*b*, if constructed) may be formed for the primary purpose of long-term storage of hazardous materials. In alternative aspects, the drillhole 104 may have been previously formed for the primary purpose of hydrocarbon production (e.g., oil, gas). For example, a storage layer may be a hydrocarbon bearing formation from which hydrocarbons were produced into the drillhole 104 and to the terranean surface 102. In some aspects, a storage layer may have been hydraulically fractured prior to hydrocarbon production. Further in some aspects, the storage casing 120 may have been perforated within the drillhole and prior to hydraulic fracturing. In such aspects, the storage casing 120 may have begun as a solid casing but, prior to emplacement of the canisters 112, become perforated.

In some aspects, the storage area of the drillhole 104, such as lateral 124*a* (or 124*b*) within the storage layer of formation 110 (or 108) can be at a depth of 1 to 1.5 km. At 1.5 km depth, a particular canister 112 (shown in lateral 124*a*) is typically surrounded by brine (for example, within the storage layer), which has a hydrostatic pressure of 2200 psi=15 MPa (15 million Pascals). In an example implementation, the canister 112 holds hazardous waste, but may not be completely filled with this waste (i.e., the waste does not completely occupy an inner volume of the canister). Half or more of the this unoccupied space might be gas, such as air, nitrogen, or helium at 1 atmosphere pressure=15 psi=1 bar=105 Pa=0.1 MPa. Thus, there would be a pressure difference across the wall of the canister of, typically, 2200 psi=15 MPa. The canister wall, therefore, can be designed to prevent collapse caused by this pressure difference.

For example, as shown in FIG. 1, a hazardous waste canister 112 can include hazardous waste 117 (e.g., nuclear waste such as spent nuclear fuel, high level waste, or otherwise) within a volume of the canister 112. The canister 112, therefore, represents a substantially hollow tubular component (with end caps to enclose the waste 117) in which a portion of the "hollowness" is filled with the waste 117. The potential collapse of tubular components (such as casings) has been extensively studied in the drilling industry, with resulting equations, tables, experimental results, and guidelines. The drilling industry conventional solution is to make the tubular components of strong material, typically steel, and to make the wall-thickness large enough that the strength of the wall will support the external pressure.

As an example, at a depth of 1500 meters, for several kinds of steel, the recommended wall thickness of a tubular to avoid collapse is 1.5 cm. At this nominal thickness, there is a 95% confidence level that there will be no collapse in 99.9% of use of the particular tubular component. That is an excellent standard for the oil and gas industry, but even this low failure rate may not be sufficient for disposal of hazardous waste such as nuclear waste. This standard implies that there may be a 5% chance that 0.1% of a canister that stores hazardous waste that is designed (for example, with a particular wall thickness) to withstand a pressure differential at a depth of 1500 meters will fail. As an example, there is about 80,000 tons of spent nuclear fuel in the United States. This could be disposed of in 160,000 canisters. If 0.1% fail, that is 160 canisters. If that happens 5% of the time, then 8 canisters will fail. Such a small number might not be sufficient for hazardous waste storage regulatory requirements. While wall thickness of the canister could be increased to, theoretically, increase the safety factor, the confidence in the projection becomes uncertain.

Example implementations of the hazardous waste canister 112 described in the present application can therefore include a pressure balancing material 119 that fills an excess space not filled by the hazardous waste 117 in an inner volume of the canister 112. The pressure balancing material 119 (e.g., gas, solid, liquid, mixed-phase material) can fill (mostly, substantially, or entirely) the excess space not filled by the hazardous waste 117 within the canister 112 to provide a force to balance a pressure exerted on an external surface of the canister 112 by the environment of the drillhole storage area (vertical or horizontal, such as drillhole 104 or laterals 124*a* or 124*b*).

In some example implementations, the pressure balancing material 119 can be a pressurized gas. For example, a tubular component (like a canister) that collapses at an external pressure of 2200 psi is typically strong enough to withstand a much higher internal pressure, e.g., 5 or 10 times greater or more than the collapse pressure. The reason is that a collapsing tubular is subject to an instability: a small deformation turns a cylindrical cross-section into an elliptical one and that increases the normal pressure on the deformed section. For that reason, the pressure balancing material 119 of a pressurized gas that fills the excess space not filled by the hazardous waste 117 in an inner volume of the canister 112 can balance an expected pressure exerted on the external surface (e.g., exposed to the drillhole 104) of the canister 112.

As an example implementation, consider a canister 112 designed to hold a single assembly of spent nuclear fuel from a nuclear reactor. The fuel and support material inside can occupy less than 50% of the volume of the canister 112. Thus, typically, 50% or more of the space is not filled with rigid material. (For certain kinds of waste, this includes the space within the material.) This unfilled space can be referred to as "excess space." This excess space is conventionally filled with a gas, such as air, nitrogen, argon, helium, or other gas at 1 atm pressure, but such gas could also be at a partial vacuum (i.e., a pressure less than atmospheric pressure). If placed underground at a depth of 1500 meters, the hydrostatic pressure on the outside of the canister 112 is about 150 atm (hydrostatic is about 1 atm per 10 meters of depth), or about 2200 psi.

By substituting the gas at 1 atm with a pressurized gas as the pressure balancing material 119, a pressure difference between exterior and interior of the canister 112 can be reduced (or even reversed if the internal pressure is higher than the external pressure). Then, when at depth, the pressure difference across the walls of the canister 112 can be close to zero, or net outward (which is more easily supported). Example tubulars that are also successfully pressurized for an external environment have gas at 2200 psi is a moderate pressure. Scuba tanks, for example, define "low pressure" as 2400 to 2640 psi, standard pressure as 3000 psi, and high pressure as 3300 to 3500 psi. Some industrial cylinders hold 6000 psi.

In some aspects, the pressurized gas that is the pressure balancing material 119 for a hazardous waste canister 112 can have a pressure set to match a pressure that can be found in the brine that will ultimately enter the drillhole storage area at a depth of the area within the storage formation (such as subterranean formation 110). Here, a "match" need not be exact; the gas pressure could be chosen to be greater than that of the outside brine in order to have a safety factor against collapse, or it could be less to reduce the positive overpressure at the surface. The internal pressure also depends on the temperature of the gas, and this will change with time as the temperature of the hazardous waste 117 (e.g., the spent nuclear fuel pellets) decreases (on a typical timescale of decades). For example, a temperature drop of 50° C. of the pressurized gas would result in a pressure drop of about 50/300=17%.

Filling a hazardous waste canister 112 with pressurized gas can create a potential puncture hazard. For instance, puncture of the canister 112 can result in a sudden release of pressurized gas, which could push the canister opposite the release of gas within the drillhole storage area or ambient environment (much like the way a pressurized balloon is pushed by released air). However, due to a weight of the canister 112 (for example, that stores a spent nuclear fuel assembly), this acceleration is not strong. For a 2 metric ton canister 112 (with spent nuclear fuel) the pressure of 2200 psi=15 MPa, resulting in a maximum force on the end of the canister 112 (area assumed at 0.07 $m^2$) of 1 MPa, giving a momentary acceleration of 0.5 $m/s^2$. In the 10 msec that the pressure would last (with the pressurized gas escaping the canister at the speed of sound), the velocity imparted would be 5 mm/sec. In summary, the considerable weight of the canister 112 prevents it from moving an undesirable distance or velocity. Of course, in the event of such a puncture, the pressurized gas would vent into the drillhole storage area (or atmosphere if the puncture occurs above ground). But under regulations, this is no worse than for an unpressurized canister, since the conservative assumption is that all radioactive gas in the canister is released even absent a pressure balancing material.

In some example implementations, the pressure balancing material 119 can be a liquid. The liquid could be pressurized when the canister 112 is sealed, or it could be left at ambient (1 atm) pressure on sealing. If it is initially at low pressure, then the liquid would become pressurized if and when the canister 112 becomes compressed, that is, occupies a reduced volume due to the outside high-pressure brine. In other words, a pressure balancing material can be a material (e.g., gas, liquid, or solid) that is inserted into the canister 112 at the terranean surface 102 in an unpressurized state (e.g., at 1 atm) but rises in pressure (i.e., becomes pressurized) when the canister 112 is subjected to an external force when emplaced that reduces the interior volume of the canister 112. In such cases, the increase in pressure of pressure balancing material 119 occurs in response to the external force on an exterior surface of the canister 112 that the material 119 is configured to support, rather than in anticipation of that force.

In an example implementation, the liquid can be water. Water has a high bulk modulus, typically 2 GPa=300,000 psi. This is a factor of 136 greater than the 2200 psi of the deep brine that can be found in the storage area in the storage formation. Thus, if subjected to the deep brine, the water in the canister would be compressed by 1/136. For a 15 cm radius hazardous waste canister, the compression is about 1 mm. Thus, when placed at depth in a canister 112 with thin walls (assume zero resistance to compression), the water would be compressed by 1 mm, which would not be enough to cause a canister 112 to get stuck in the drillhole 104 (such as stuck on a casing) or to undergo collapse.

If there is a puncture in a liquid filled and pressurized canister 112, that liquid will be released through the puncture, but the pressure will not drop rapidly. After 1% of the liquid is released, the interior drops to atmospheric pressure. This is in contrast to the pressurized gas filled canister, which loses virtually all of its gas when punctured.

One particular issue is the heating of the water by the waste 117, such as by spent nuclear fuel or other radioactive waste, with its consequential increase in pressure. The volume coefficient of expansion of water is about 0.0005 per° C., so for a 50° C. increase in temperature, unconstrained water will expand by 2.5%. This can cause a thin-walled canister 112 to expand by 2.5%, which for a 15-cm radius, is accommodated by a 4 mm increase in circumference. In a thicker wall canister 112, the effect can be to raise the pressure to limit the expansion.

In some aspects, pressure limiters 121 can be placed in the inner volume of the canister to prevent a high pressure rise. These pressure limiters 121 can be gas or vacuum-filled spheres with walls designed to collapse when a critical pressure is reached. The total volume of the pressure limit need be no more than a few percent of the excess space. The pressure limiters 121 can also be designed to shrink in volume as the pressure increases, thus allowing volume expansion while limiting pressure rise. An example of this type of pressure limiter can be a bellows with a spring that keeps it expanded at low pressure but not at high pressure.

In some aspects, a pressure rise of the liquid in the excess space from heating (by the waste) can be used as a benefit to offset the exterior pressure exerted by the brine on the canister 112. A desired pressure increase on the interior can be set by introducing a liquid, such as water, at a prescribed temperature. Based on modeling and tests, an expected rise of the temperature of the liquid can be known, and a temperature of the liquid introduced into the excess space can be set such that its warming can create an internal pressure sufficient to balance the external pressure. This effect may endure only as long as the waste in the canister 112 is producing heat at a particular power (or temperature). Such effect can occur for a decade or two (e.g., in the case of spent nuclear fuel); after that time, the pressure inside would be reduced.

In contrast to introducing a heated liquid, a liquid at a lower temperature than the fuel temperature can be introduced into the excess space and the canister 112 can then be sealed. For example, water is introduced at 50° C. Because of the presence of the waste (e.g., spent nuclear fuel), the water can warm to, say, 150° C. (It could go higher without boiling, since the pressure will be rising.) That is a 100° C. rise in temperature. The coefficient of expansion of water is about 0.0005 per° C., so it expands by about 2.5%. The bulk modulus of water is about 2 GPa=315,000 psi. Thus, an internal pressure can be generated of 8000 psi. This pressure is contained in the canister 112, and will more than offset the external 2200 psi from brine at the depth of the storage formation. In time, the water will cool.

In some aspects, to maximize the fill of liquid into the excess volume, the liquid can be pumped on the surface of the liquid to reduce the pressure of the fluid. Doing so can make any gas pockets within the liquid expand, and more likely to leave a location where it is trapped and escape to the surface. Such a procedure is commonly used to "de-gas" liquids, but it also serves to extract trapped gas pockets.

Another liquid that can be introduced into the excess space of the canister 112 is liquid salt, which, in some cases, can be a solid at room temperature but liquefy when heated. Liquid salts are used in liquid salt reactors and in solar-thermal power plants. Liquid salts melt when moderately heated, and flow to transport the heat.

In some aspects, a liquid salt that can be used as a pressure balancing material 119 is a eutectic mixture of sodium nitrate ($NaNO_3$) and potassium nitrate ($KNO_3$). This liquid salt has a melting point of 260° C. to 550° C. This liquid salt can be melted, added to the inner volume of the hazardous waste canister 112 to fill at least a portion of the excess space in which the waste 117 (e.g., hot fuel assembly) is enclosed, and then sealed within the canister 112. When the canister 112 eventually cools, the liquid salt can harden into a solid.

As compared to water as the liquid, a liquid salt contains no hydrogen. For example, hydrogen in the water (as the liquid) can be converted to gas when irradiated by gamma rays (e.g., from the radioactive waste stored in the canister) in a process called radiolysis. An excess of hydrogen gas in a sealed canister can cause an overpressure inside the canister. Molten salt avoids this potential problem, because it contains no hydrogen. In practice, a type of salt that has low hydrogen contamination can be selected as the pressure balancing material.

In some example implementations, the pressure balancing material 119 can be a solid. For example, if the excess space in the inner volume of the canister 112 is sufficiently connected, then it could be filled with a solid. An example solid is a granular or particulate solid, such as, for example, sand. Sand has high compressive strength, and pure sand is highly conductive of heat and resistant to damage from radiation and corrosion. In the case, however, of an excess space that has disconnected portions, sand may fill all the small spaces in the canister 112 with difficulty. For example, if the canister 112 contains spent nuclear fuel assemblies, then there are small gaps between the fuel rods in which the sand might not reach, although vibrating the canister 112 on a shake table might overcome that issue.

In some aspects, a solid material as the pressure balancing material 119 can offer even more protection against an accidental puncture, since very little hazardous material 117 would be released before the puncture could be sealed by the solid material.

In some aspects, such as to maximize the filling of the excess volume, a material that is initially liquid with low viscosity, but then becomes a solid, can be chosen as the pressure balancing material 119. One example is a fusible alloy, i.e., a material that becomes solid when cooled. A common example is solder, which melts at (typically) 185° C. The alloy can be heated and poured into the canister 112; it might remain liquid in the vicinity of the waste 117 (such as spent nuclear fuel pellets that generate heat) but would solidify elsewhere in the excess space. If the heat generation is low, the material 119 would solidify and provide a heat conduction path to the exterior of the canister 112.

In other example aspects, a pressure balancing material 119 can be a solid that forms from a liquid. For example, such a material 119 can be epoxy. An epoxy resin, mixed with a hardener, can be poured into the canister 112 to fill the excess space. In some aspects, the epoxy resin can be pumped into the excess space to reduce trapped bubbles. If the epoxy resin is selected with a sufficiently long hardening time, then the fill would become a solid. The hardening time can take into account that many epoxies harden more quickly at high temperature, and the temperature of the waste 117 (e.g., spent nuclear fuel) may be elevated by the heat that they generate. Other example materials 119 that harden when cooled or which set with time include acrylic resins, benzoxazines, vinyl esters, other thermosetting resins, or other plastics, and gallium metal.

If the canister 112 has internal space that is not filled with a compression-resistant material (e.g., sand or high pressure gas), then there is a danger that the external pressure can cause the canister to collapse inwardly and potentially leak hazardous waste into the repository geologic layer (and possibly into mobile water than can reach the surface).

As noted, conventionally, this collapse can be countered by making the canister with thicker walls and/or using high-strength materials in such walls, which can increase cost and weight of the canister (both potentially detrimental effects). The walls (e.g., side wall of a cylindrical canister, as well as a cap and end) of the canister serve multiple purposes. One purpose is to resist corrosion, but corrosion-resistant materials are not necessarily the strongest materials. Also, making the canisters thicker, particularly if is made of a specialized corrosion-resistant metal such as Alloy 22, can make the canister very expensive.

The present disclosure describes example implementations of a hazardous waste canister that has a double wall (or double layer) housing (e.g., a cylindrical double-wall housing) into which hazardous waste can be inserted and enclosed. Once inserted, a cap or top can be attached (e.g., welded or otherwise) onto the double-wall housing to seal the hazardous waste within an interior volume of the double-wall housing.

Figure 2B:
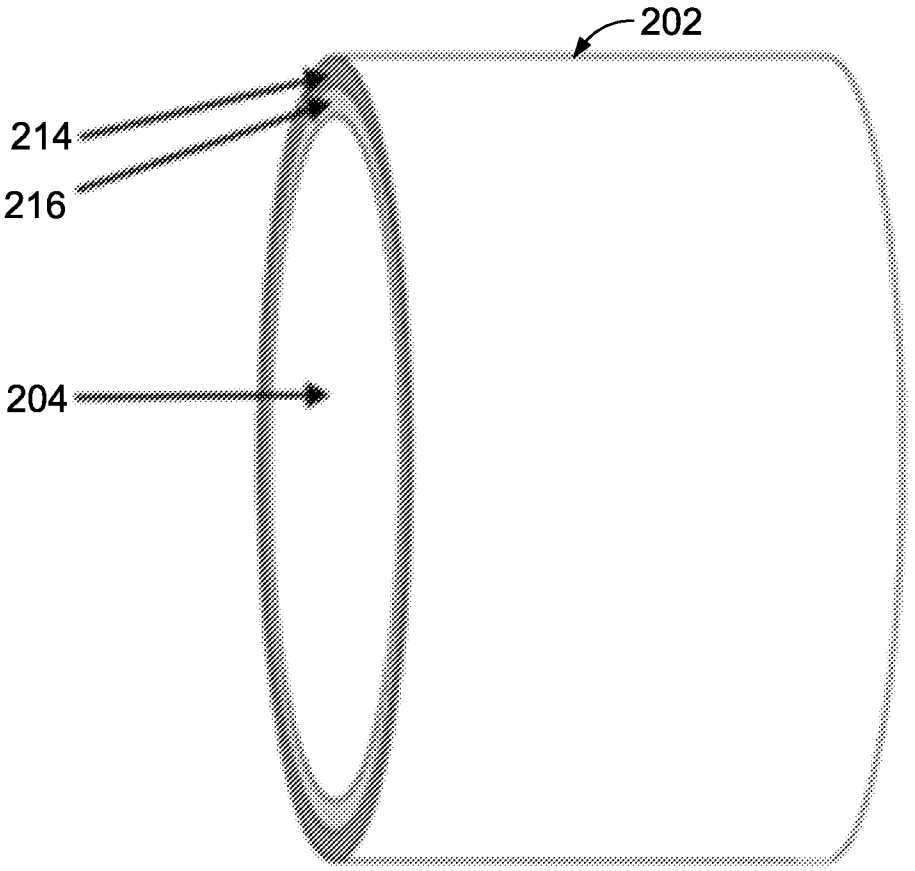
FIGS. 2A and 2B are schematic illustrations of an example implementation of a hazardous waste canister according to the present disclosure.
Figure 2A:
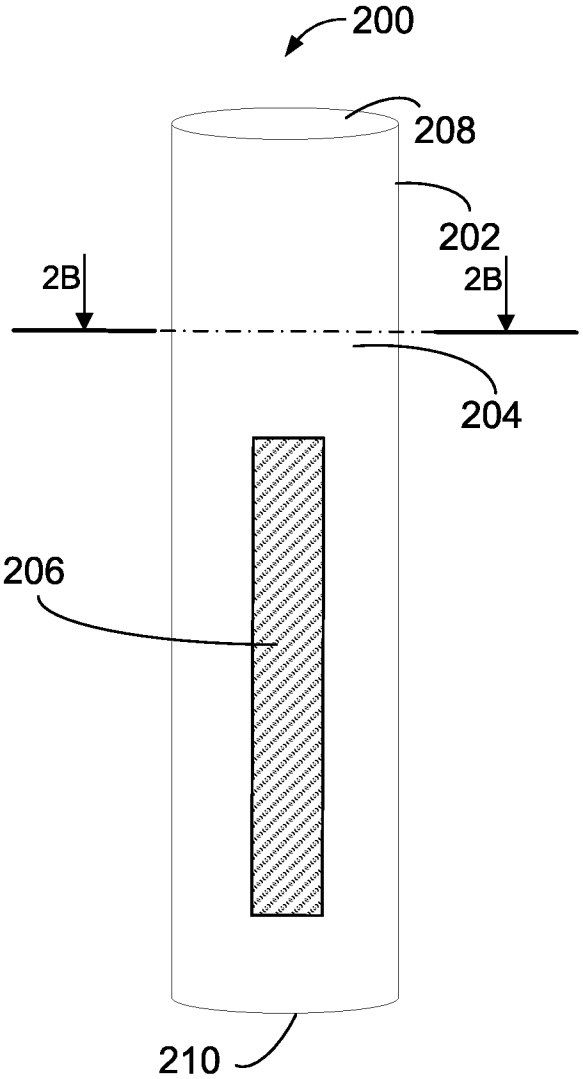

An example implementation of a laminated hazardous waste canister 200 is shown in FIG. 2A, with a radial cross section of the canister 200 shown in FIG. 2B. As shown in FIG. 2A, the canister 200 can include a housing 202 that defines an interior volume 204 into which hazardous waste 206 (e.g., nuclear, radioactive, or other waste) can be enclosed. Ends 208 and 210 (such as a top 208 and a bottom 210) can be attached to or integrally formed with the housing 202 to enclose the hazardous waste 206 within the volume 204.

FIG. 2B shows a radial cross-section of the laminated hazardous waste canister 200 that, in this example, includes a cylindrically-shaped housing 202 (with a circular cross-section). In this example, the canister 200 includes an outer corrosion-resistant layer 214 and an inner collapse-resistant layer 216. The interior volume 204 is sized to hold, e.g., a portion of radioactive waste 206, such as at least a portion of a spent nuclear fuel assembly.

In some aspects, the double-wall housing 202 includes a wall 214 configured to resist corrosion within a drillhole subjected to brine or other corrosive substance. The double-wall housing also includes a wall 216 configured to resist collapse under a pressure that, e.g., the brine would be at within a drillhole. For instance, in example implementations according to the present disclosure, a double-wall housing 202 for a canister includes a laminated housing. The laminated housing is comprised of two layers: an outer layer 214 manufactured of a material or constructed for corrosion resistance, and an inner layer 216 manufactured of a material or constructed for collapse resistance. In some aspects, the outer layer 214 can be formed of Alloy 22, and the inner layer 216 can be formed of high strength carbon steel. Because of the relative strength of the steel inner layer 216, the total thickness of the inner layer 216 need not be as great as it would be if the canister housing 202 was constructed of Alloy 22 alone for an equal relative strength. Moreover, the inner layer 216 of carbon steel, by adding strength, reduces stress on the outer layer 214 formed of a corrosion resistant material. By reducing such stress, a rate of stress corrosion in the material of the outer layer 214 can also be reduced.

In an example implementation, the inner layer 216 can be slipped inside the outer layer 214, or it could be attached to the outer layer 214 with a material that acts as an adhesive. In some aspects, an annulus between the inner layer 216 and the outer layer 214 can be filled (partially or wholly) with a fluid (e.g., liquid, gas, or mixed phase fluid) that transfers a force of compression from the outer layer 214 to the inner one 216.

In some aspects, only a part of the housing 202 is laminated (i.e., includes the outer layer 214 and the inner layer 216). For example, in some aspects, only a tubular portion of a cylindrical housing is laminated, as the ends of the housing (e.g., cap and base) may not be laminated (e.g., as such portions of the housing may not be prone to pressure collapse).

In some aspects, a combined thickness of the inner and outer layers is less than a thickness of, e.g., a single layer housing for a hazardous waste canister. For example, in a single-wall (or single layer) housing that is formed of a homogenous material (such as Alloy 22), such a homogenous material (and single layer) serves two purposes. Such material must be thick enough to have a desired lifetime against corrosion (i.e., a "corrosion thickness"). Such material must also be thick enough to prevent pressure collapse (i.e., a "collapse thickness"). For Alloy 22, as an example, the pressure thickness is typically larger than the corrosion thickness. With a laminated housing, some of that thickness (of a single layer housing) can be reduced and be replaced by a thinner layer of a stronger material (e.g., the inner layer of carbon steel). Thus, the overall thickness of a double-wall (or double layer) housing can be reduced relative to a single layer housing. This reduction, for example, can allow the construction of a smaller (in diameter) drillhole to accommodate a smaller (in outer diameter) hazardous waste canister, or can provide for a larger (in outer diameter and inner volume) hazardous waste canister (to hold more waste)

Figure 3B:
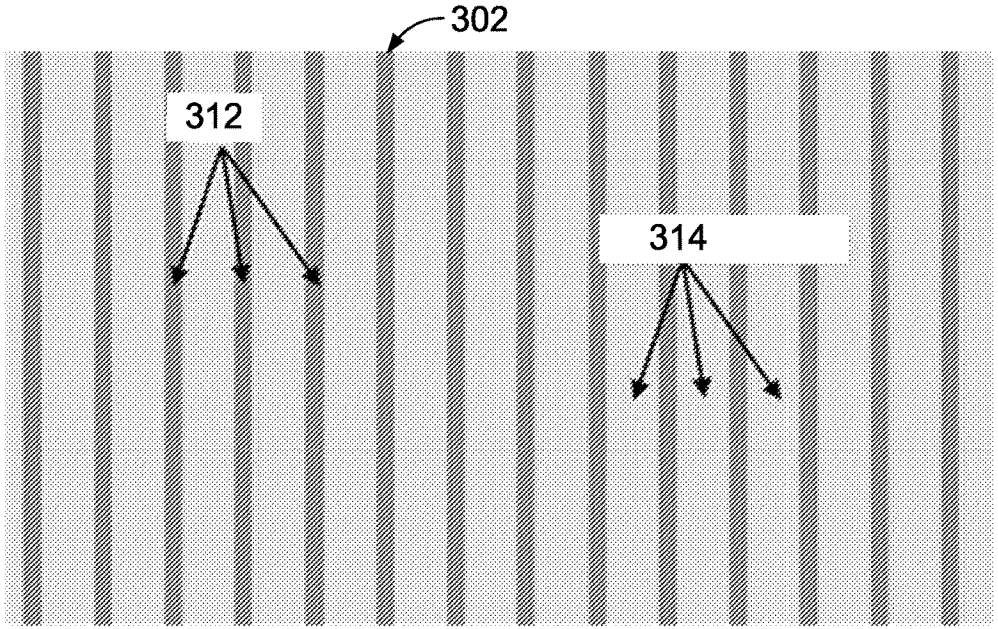
FIGS. 3A and 3B are schematic illustrations of another example implementation of a hazardous waste canister according to the present disclosure.
Figure 3A:
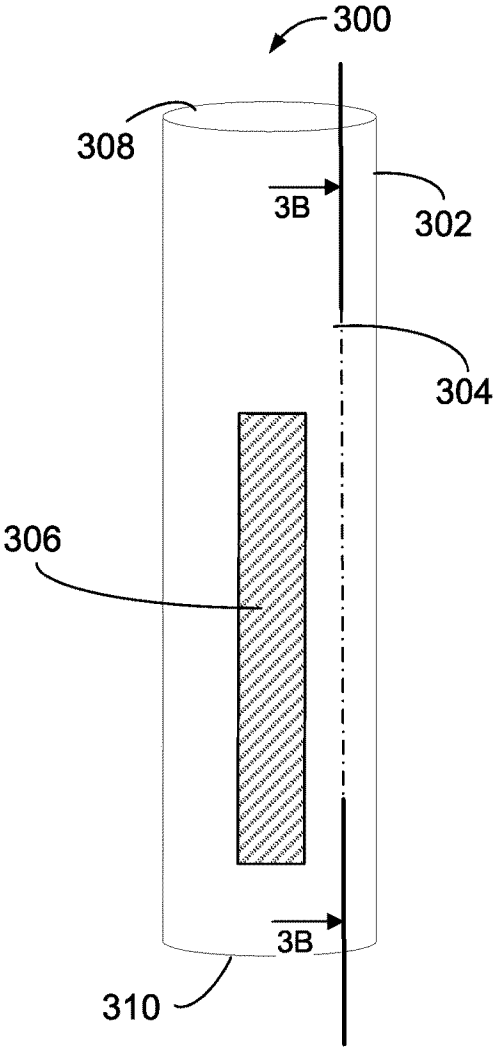

In another example implementation as shown in FIGS. 3A-3B, a hazardous waste canister 300 with a double-wall (or double layer) construction can include a ribbed inner layer rather than a solid inner wall (e.g., cylinder) as described previously. For instance, an example implementation of a laminated hazardous waste canister 300 is shown in FIG. 3A, with an axial cross section of the canister 300 shown in FIG. 3B. As shown in FIG. 3A, the canister 300 can include a housing 302 that defines an interior volume 304 into which hazardous waste 306 (e.g., nuclear, radioactive, or other waste) can be enclosed. Ends 308 and 310 (such as a top 308 and a bottom 310) can be attached to or integrally formed with the housing 302 to enclose the hazardous waste 306 within the volume 304.

In this example implementation, collapse of the canister can be resisted by a solid inner cylinder 312 (i.e., inner layer) as shown in FIG. 3B, but in some aspects, the inner layer 312 is not continuous. Thus, the inner layer 312 can have regions or areas removed to, e.g., reduce its weight and cost of material. As an example, the inner layer 312 can be formed of individual hoops (or ribs), as shown, placed along the length of the canister 300 (e.g., parallel to an axial dimension of the canister 300, as shown in FIG. 3B) or along a circumference of the canister 300 (e.g., about an axial centerline of the canister 300). Such hoops, even if spaced, offer resistance to the collapse by increasing the "hoop strength" of the outer cylinder 314/inner cylinder 312 combination. The hoops can be supported by a cylindrical sheet of metal or by connecting rods or other supports to make insertion and placement easier. The sheet of metal supporting the hoops can be relatively thin since its primary purpose is ease of placement, not structural strength.

For example, FIG. 3B shows a portion of an example implementation of the housing 302 that includes parallel hoops positioned within or supported by an outer layer 314 (such as metal). In this example, while the illustration is flat and two-dimensional, the hoops would curve over the cylindrical surface 314 to form rings (i.e., closed hoops) for the canister housing 302 (e.g., integrally with an outer layer).

Figure 4B:
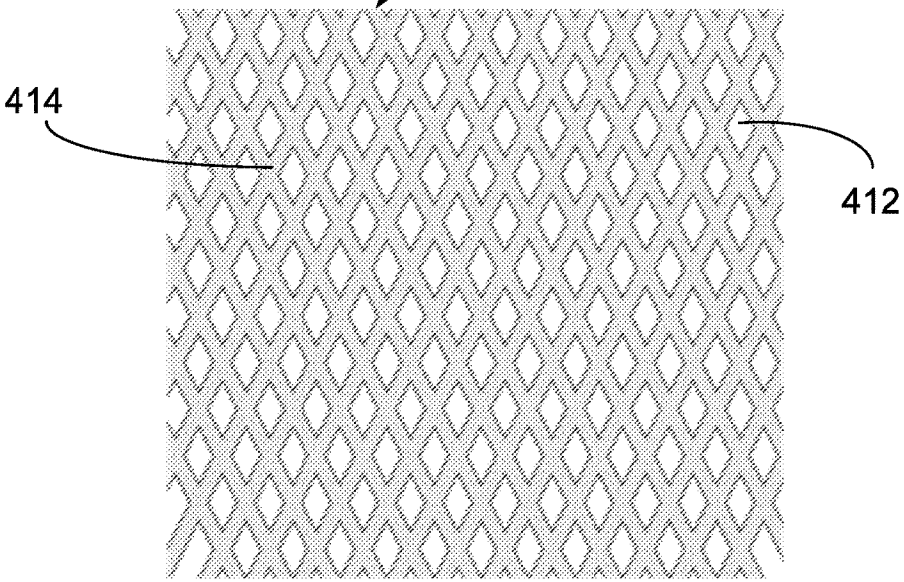
FIGS. 4A and 4B are schematic illustrations of another example implementation of a hazardous waste canister according to the present disclosure.
Figure 4A:
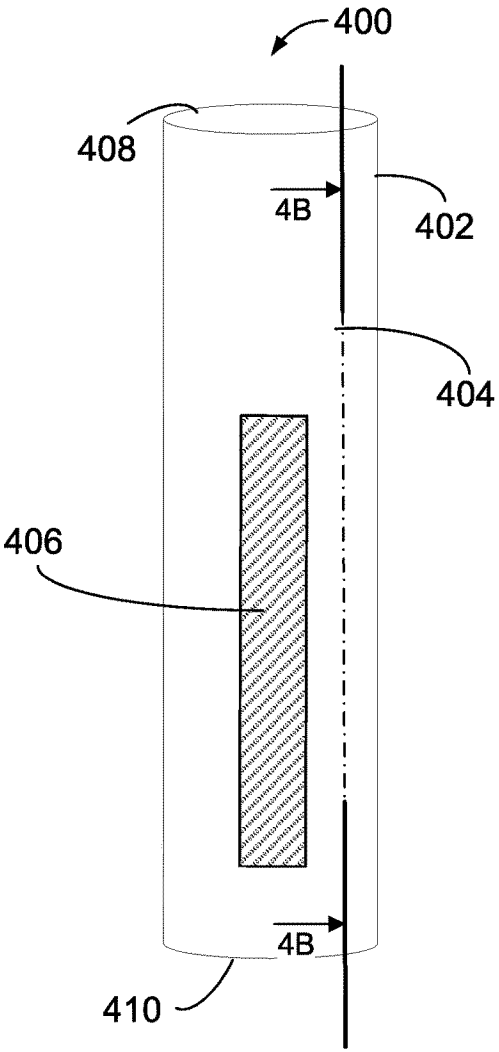

In another example implementation as shown in FIGS. 4A-4B, a hazardous waste canister 400 with a double-wall (or double layer) construction can include a "waffle" pattern (e.g., criss-crossed) inner layer rather than a solid inner wall (e.g., cylinder) as described previously. For instance, an example implementation of a laminated hazardous waste canister 400 is shown in FIG. 4A, with an axial cross section of the canister 400 shown in FIG. 4B. As shown in FIG. 4A, the canister 400 can include a housing 402 that defines an interior volume 404 into which hazardous waste 406 (e.g., nuclear, radioactive, or other waste) can be enclosed. Ends 408 and 410 (such as a top 408 and a bottom 410) can be attached to or integrally formed with the housing 402 to enclose the hazardous waste 406 within the volume 404.

In this example, the inner layer 414 and the outer layer 412 of a double layer housing 402 for the hazardous waste canister 400 can be made or formed separately. Alternatively, in some aspects, the inner layer 414 and outer layer 412 can be made of the same material, and they could be manufactured out of a single piece rather than of multiple pieces attached to each other. This may lose some of the advantages of the two piece design, but still have beneficial ratio of strength to weight.

Additional layers (beyond the double layer as described with reference to FIGS. 2A-2B, 3A-3B, and 4A-4B) can be attached to or formed on a canister (e.g., the exterior surface of the canister). For example, a coating, such as diamond or quartz coating can be attached to an outer layer of a canister to achieve corrosion resistance with less total weight.

Figure 5:
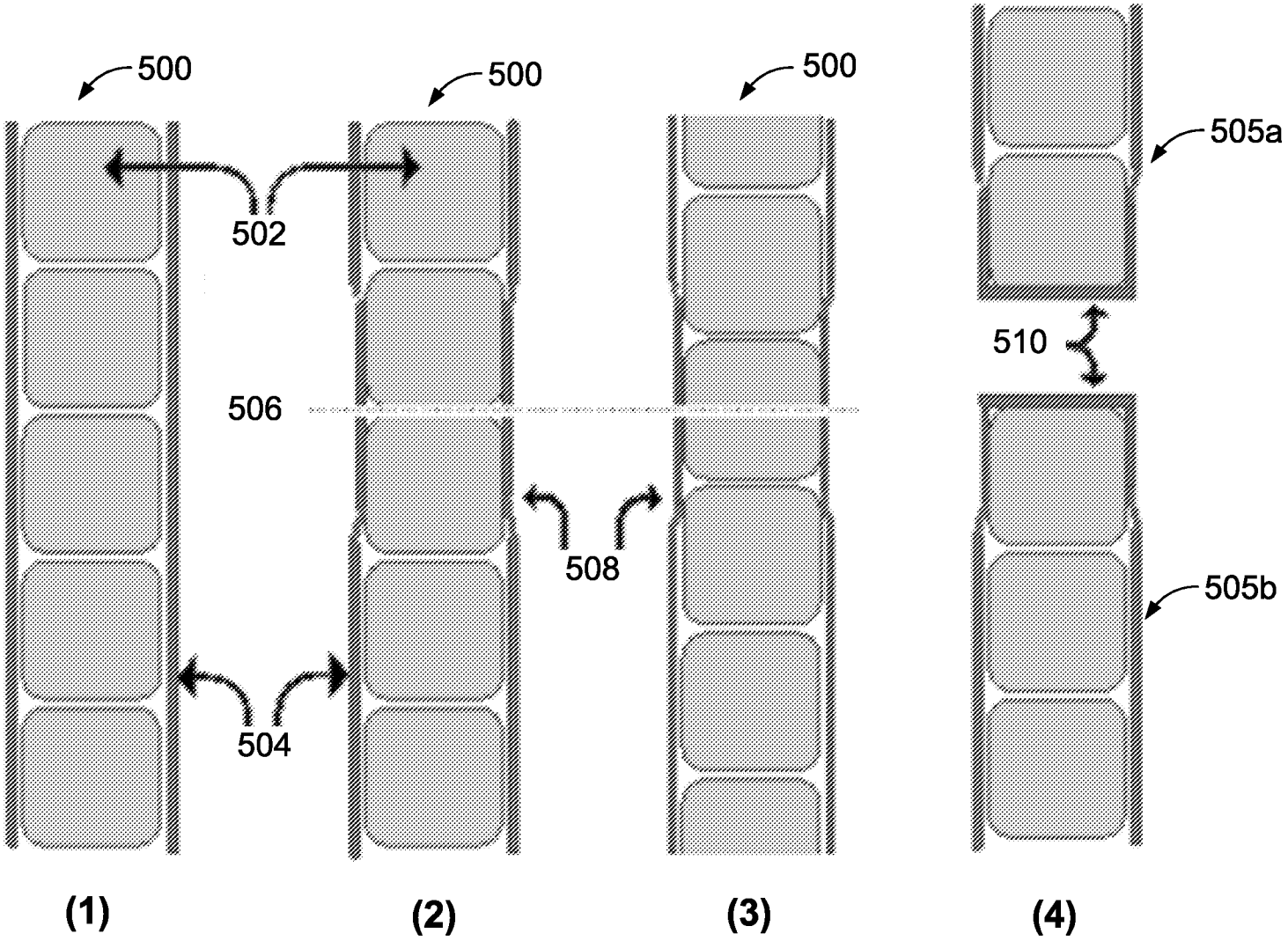
FIG. 5 is a schematic illustration of an example method for processing a spent nuclear fuel rod according to the present disclosure.

FIG. 5 is a schematic illustration of an example method for processing a spent nuclear fuel rod according to the present disclosure. For example, spent nuclear fuel (SNF) rods that hold spent nuclear fuel pellets are typically 14 feet long and a bit over 1 cm in diameter. SNF rods (a portion of which is shown in FIG. 5 as SNF rod portion 500) are typically made of a hollow tube called the "cladding." Typical dimensions for the cladding are 9 to 10 mm in diameter, and 0.5 to 0.6 mm in wall thickness. The cladding (shown as cladding 504) is typically manufactured from a zirconium alloy called Zircaloy, although aluminum or other metals and alloys can be used. One SNF rod might hold 400 or more SNF pellets. These pellets (shown as pellets 502) are typically uranium dioxide ceramic with a few percent component of isotopes and radioisotopes that were created by nuclear processes while the rod was within an active nuclear reactor. Many SNF rods are combined together in a single spent nuclear fuel assembly.

The long length of these SNF rods creates handling difficulties, particularly after the SNF assemblies are removed from a nuclear reactor. The SNF assemblies are also highly radioactive. The SNF pellets can, in theory, be removed from the rods by opening the ends and slipping out the pellets; this is done, for example, when spent nuclear fuel is reprocessed for the recovery of useful isotopes such a plutonium and americium. However, after several years in a nuclear reactor, the pellets sometimes swell and are difficult to remove. In addition, radioactive gases emitted from the pellets, including tritium and krypton-85, can escape when the rods are opened. For a typical exposure in a nuclear reactor, the fuel rods contain over 500 curies of tritium per and over 10,000 curies of krypton-85 per ton. These isotopes have half-lives just over a decade, and they present a radiation hazard.

Implementations according to the present disclosure include systems and methods for separating a SNF rod 500 (shown as a portion of a rod) into segments of shorter length (e.g., relative to a whole, unseparated SNF rod) while minimizing the escape of radioactive isotopes during and after the separation process. The disclosed systems and methods shorten a whole SNF rod into several, shorter portions of the SNF rod inexpensively and with low risk of radioisotope leakage during and after the shortening process. The separated (i.e., shortened) SNF rod portions may facilitate easier and more efficient disposal of spent nuclear fuel by eliminating issues caused by the long length of the SNF rods.

For example, the shortened SNF rod portions may be enclosed in a nuclear waste canister (such as canister 112, canister 200, canister 300, or canister 400) that is then stored (e.g., for hundreds if not thousands of years) in a hazardous waste repository formed in a deep, human-unoccupiable directional drillhole. In some aspects, the dimensions of the canister (e.g., length and diameter) as well as the shape of the canister (e.g., cylindrical, spherical) may be constrained by the dimensions of the nuclear waste to be stored in the canister. A whole SNF rod (or whole SNF assembly comprising several whole SNF rods) may require a longer canister than several SNF rod portions (that together, comprise the same amount of SNF pellets as the whole SNF rod). Relatively, a longer and heavier canister that is sized to contain a whole SNF rod may be more prone to damage when placed in the deep directional drillhole, e.g., if there is substantial ground movement due to an earthquake fault that shears the long canister. Relatively shorter canisters that are sized to store SNF rod portions, or spherical canisters sized to store SNF rod portions may sustain little or no damage during a ground movement event (e.g., a seismic event). However, such canisters require the shortening of the fuel rods, that is, the division of 14-foot fuel rods into rod portions that are shorter, e.g., half as long, a quarter as long, a third as long, or other percentage of a whole length (even as short as a foot or less in length).

In an example method for forming multiple SNF rod portions from a whole SNF rod 500 (shown in "(1)" of FIG. 5), one or more planned "cuts" 506 (e.g., radial cuts through the SNF rod 500) of the whole SNF rod may be determined (shown in "(2)" of FIG. 5). Next, the cladding 504 of the whole SNF rod 500 may be crimped 508 just above and below each of the determined one or more cuts (shown in "(2)" and "(3)" of FIG. 5). In some aspects, the crimping 508 may create a strong ceramic-metal seal at the crimped portions of the SNF rod 500. Zircaloy, for example, has a yield strength of 381 MPa (8,600 lb per cm2). In some aspects, the cladding 504 can be squeezed by a cylindrical vise to compress around adjacent fuel pellets 502 (e.g., that are positioned on either side of the crimp 508). The adjacent pellets 502, being solid with no voids, may readily provide the resistance force that will cause the Zircaloy to yield and creep to make a tight metal-ceramic seal.

Next, the cladding 504 can be cut at the crimped locations of the SNF rod 500 (shown in "(3)" of FIG. 5). The metal of the cladding 504 is not highly radioactive; indeed, the metal (typically zirconium) may have a very low probability of absorbing neutrons, and thus it remains relatively low in radioactivity. Thus, when the cladding 504 is cut, only relatively small amounts of radioisotopes may be found in the cuttings. These include some gases such as tritium and krypton that have diffused into the surface of the cladding. Nevertheless, the material removed from the cutting can be minimized by making a thin cut. The cut could be done mechanically or with a laser cutting tool. A narrow cut less than 0.001 inch in width would keep the debris to a low level.

In some aspects, the cladding 504 can be cut in-between SNF pellets 502. Doing so means that the pellets 502 themselves would not be cut. In this space there may be some radioactive gas, particularly tritium and krypton-85, but because of the crimping, no gas from the space between pellets 502 may be able to reach the opening. This is shown in "(2)" of FIG. 5.

Next, once the cuts 506 are made, one or more caps 510 may be secured over the cut ends, thus forming two or more SNF rod portions 505*a* and 505*b*, each of which is shorter than the whole SNF rod 500. For example, once the cladding 504 is cut, the two ends can be separated, and caps 510 can be welded on to the open ends of the cladding 504. This is shown in "(4)" of FIG. 5. These caps 510 will typically be made of the same material as the cladding 504, e.g. Zircaloy. They can be welded using standard welding methods, or can be spin welded by spinning the caps as they are pressed against the cut cladding 504.

In the example shown in FIG. 5, the SNF rod 500 (with SNF pellets 502 in the cladding 504 as shown) has a diameter of about 1 cm. The SNF pellets 502 are cylindrical in shape, with length and diameter just under 1 cm. FIG. 5 "(1)" shows a cross-section of part of the SNF rod 500, with cladding 504 and pellets 502. FIG. 5 "(2)" shows a possible location for the crimp 508 and a cut 506 that allows separation of the two pieces without breaking any SNF pellets 502. FIG. 5 "(3)" shows crimping 508 and cutting 506 at a location at which one of the SNF pellets 502 itself will be cut. FIG. 5 "(4)" shows the separated sections 505*a* and 505*b* from "(2)," with caps 510 welded over the open ends of the cut cladding 504.

As noted, the cladding 504 may be cut at a location where a SNF pellet 502 is located. This is illustrated in "(3)" of FIG. 5. Once the fuel pellet 502 is reached, then the pellet could be cut through using a cutting technique appropriate for the ceramic material of the pellet 502. This could be a thin diamond saw, a laser cutter, and other methods. Laser drills can currently make holes less than 10 microns (0.01 mm) in diameter in ceramics, and they could be used to either slice the fuel pellets 502.

The ceramic pellets 502 at the cut depth in "(3)" of FIG. 5 could also be broken rather than cut. Doing this could reduce the amount of the pellet that is scattered as debris. This could be done, for example, by scoring the pellet 502, that is, by cutting a short distance into the surface of the pellet to provide a location that would initiate a break when a bending moment is applied to the pellet 502; this method is analogous to the breaking of a piece of glass along a line on the surface at which it has been scored. Another approach is to drill a series of narrow holes, perhaps each less than 10 microns (0.01 mm) in diameter, and then apply a bending moment; the ceramic pellets 502 would tend to break at the depth of these holes.

In some implementations, the locations of the SNF rod 500 that are to be cut are cooled (e.g., below −157° C.) before any cuts 506 are made. Since the freezing point of krypton is −157° C., most of the gas would be held on the cladding 504 or the pellets 502 when the SNF rod 500 is cut and would not be released. Once the cap 510 is secured, and before the cap 510 is welded, the temperature of the SNF rod portion (e.g., 505*a*) could be allowed to rise. With the cap 510 in place, the krypton gas would remain confined in the cladding 504. Such a method would not solidify the tritium gas, but the krypton typically represents a much higher level of radiation danger. As another example as to installing a cap 510, a hole could be drilled in the cladding 504 at a location between fuel pellets 502 and to inject a material that will form the cap 510. This could be liquid Zircaloy that hardens into a solid Zircaloy cap 510.

Figure 6B:
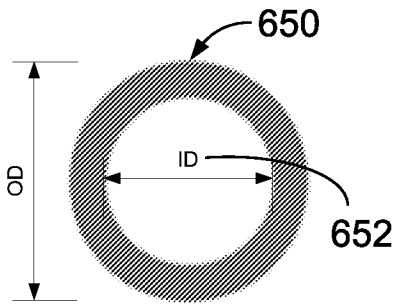
FIGS. 6A and 6B are schematic illustrations of an example implementation of a radiation shield for a hazardous waste canister according to the present disclosure.
Figure 6A:
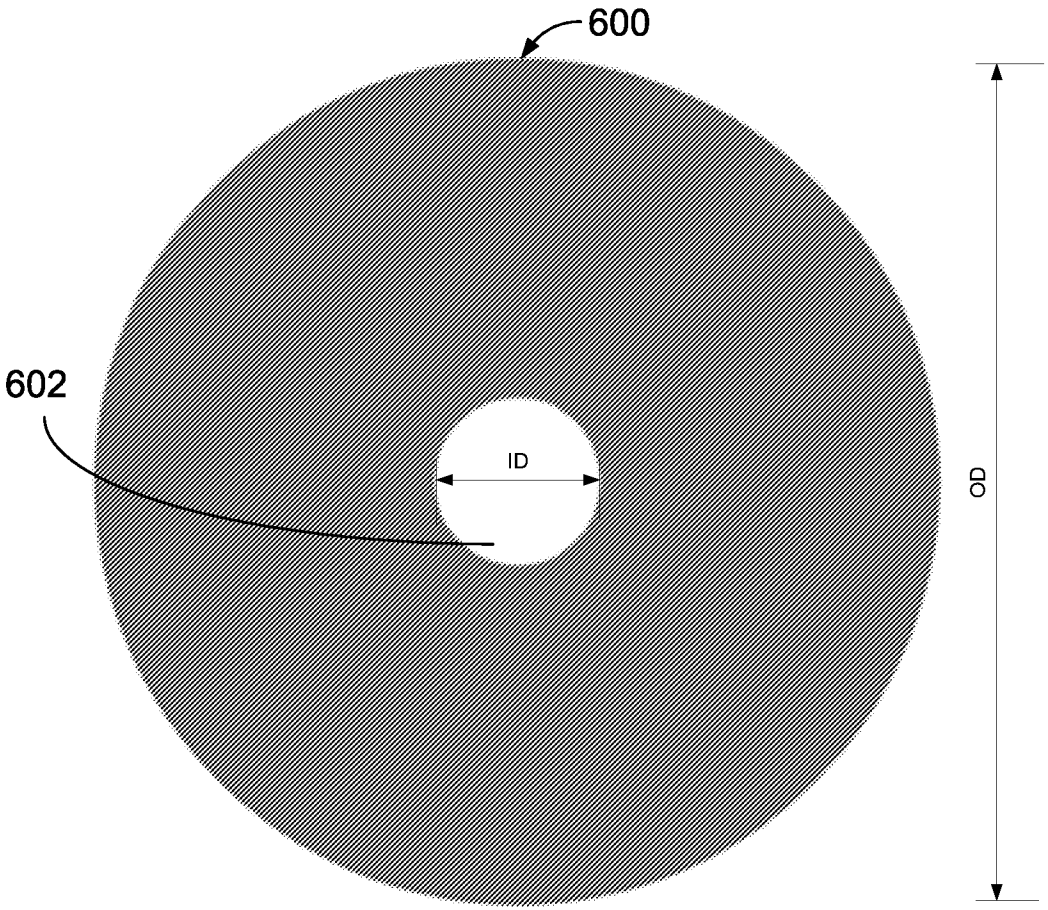

FIGS. 6A and 6B are schematic illustrations (e.g., top views) of an example implementation of a radiation shield for a hazardous waste canister according to the present disclosure. For example, spent nuclear fuel assemblies (and other radioactive waste) are highly radioactive. If placed in a metal canister that has a wall thickness of 8 mm thick, then emitted alpha and beta radiation are absorbed in the canister wall. However, gamma radiation (e.g., gamma rays, x-rays, or both) is highly penetrating and most of it escapes through the wall of such a canister.

To prevent harm to nearby humans in the proximity of the metal canister that stores one or more spent nuclear fuel (SNF) assemblies, it is conventional to place, typically, 2 feet of concrete shielding around the radiation source (e.g., the metal canister that stores the SNF assemblies). Thus, for an unmodified SNF assembly from a pressurized water reactor with a diagonal size of 12 inches, the outer diameter of the canister to contain the SNF assembly is about 13 inches. Therefore, an inner diameter of the concrete shield would be 14 inches. With a wall thickness of two feet, an outer diameter of the shield is 14 inches plus four feet. The volume of the concrete in the shield is 7.9 m3, and the mass is 17 metric tons (17 MT). This huge mass presents handling challenges for a shielded SNF assembly canister.

The present disclosure describes example implementations of a radiation shield for a nuclear waste canister that encloses nuclear waste (e.g., one or more SNF assemblies). In some implementations, the radiation shield is constructed of a non-cementitious material (e.g., not concrete). In some aspects, the radiation shield material comprises tungsten or depleted uranium (DU).

Shielding for gamma rays in the range of 0.5 to 2 MeV, which covers most of the gammas from spent nuclear fuel, typically does not depend strongly on the material used in the shield. A key number is the mass per unit area, measured in grams per square centimeter. To reduce gamma radiation by a factor of 10 (i.e., a 90% reduction), 10 inches of concrete or 1 inch of tungsten on all sides is sufficient. For a 99% gamma ray attenuation, twice as much thickness, e.g., 20 inches of concrete or 2 inches of tungsten is sufficient. Yet the weight of the two shields is not dramatically different: 350 grams per square inch for concrete and 300 grams per square inch for tungsten (e.g., 14% lower). As a consequence, although the tungsten or DU shield can have a wall thickness dimension that is less than that of the concrete radiation shield, there is too little weight advantage to justify the much higher expense of tungsten. Thus concrete is usually chosen as the shield of choice for large volumes of radioactive materials.

As noted, another material for shielding is depleted uranium, that is, uranium which has had most of its fissionable component (U-235) removed. Depleted uranium is similar in shielding effectiveness to tungsten, but it has the advantage of being less expensive. Depleted uranium can be purchased for, typically, $5 per pound, whereas tungsten typically costs $14 per pound.

In some aspects, a tungsten or DU radiation shield is used when the radiation shield surrounds the radioactive material, and the required shield thickness for concrete is larger than a characteristic dimension of the radioactive material (e.g. its radius). This is the geometry, for example, when an unmodified fuel assembly is placed in a cylindrical canister. In that geometry, there can be substantial weight savings in going to a denser shield made of tungsten or depleted uranium, because, for example, the cross-sectional area depends of the square of the radius (i.e., the thickness of the shield). So a thinner shield has a significantly reduced area and volume.

A typical SNF assembly is 14 feet long. A shield this long made of concrete would weigh 46 metric tons (to prevent a sufficient percentage of gamma radiation from passing therethrough). A radiation shield made of tungsten or DU (that shields the same percentage of gamma radiation) would weigh about 16 metric tons. These weights do not include end caps. Thus, a tungsten or DU radiation shield may provide a substantial saving in both space and weight. A considerable weight reduction is achieved, in violation of the usual rule-of-thumb, because of the fact that in the cylindrical geometry the mass of the shield increases not linearly with thickness, but more closely as the square of the thickness.

FIGS. 6A-6B illustrate a dimensional comparison of a conventional cylindrical concrete radiation shield 600 and an example implementation of a tungsten or depleted uranium radiation shield 650 for a nuclear waste canister. For example, in FIGS. 6A-6B, both the cylindrical shield 600 of concrete and the cylindrical shield 650 of tungsten (or DU) include a hole 602 and 652, respectively, that is sized to circumscribe a canister containing a SNF assembly for a nuclear reactor. A SNF assembly is typically 8-inches in diagonal; the cylindrical canister is assumed to be 9 inches in outer diameter. Thus, a radiation shield for such a canister has an inner diameter (ID) of about 10 inches (to provide some clearance) and an outer diameter (OD) sized according to a particular wall thickness). The wall thickness (½ of the OD-ID) of the shield is sufficient to stop a predetermined amount of gamma rays from the SNF assembly that pass through the metal canister, e.g., 99% of the gamma rays. For the conventional cylindrical concrete shield 600, that is a thickness of about 20 inches. For the example implementations of the tungsten or DU cylindrical radiation shield 650, the wall thickness is about 2 inches.

Although the relative wall thickness of the concrete radiation shield 600 to the wall thickness of the tungsten or DU radiation shield 650 is about 10:1, the relative area (representing the amount of material) is 25:1. As a result, there can be substantial weight savings of a tungsten or DU radiation shield 650 in this configuration over a concrete radiation shield 600. The density of concrete is about 2.2 metric tons per $m^3$, and the density of tungsten or DU is about 19 metric tons per $m^3$. Thus, the ratio of concrete density to tungsten or DU density is about 1:8.6. Thus, the radiation shield 650 of tungsten or DU has a weight that is reduced by a factor of almost three relative to the concrete radiation shield 600. In other words, the tungsten or DU radiation shield 650 weighs 34% as much as the conventional concrete radiation shield 600, in addition to being much smaller. Both the smaller size and lower weight of the example implementation of the tungsten or DU radiation shield 650 of FIG. 6B can provide advantages in transportation and handling relative to the conventional concrete radiation shield.

In some aspects, the dimensions of the tungsten or DU radiation shield 650 as shown in FIG. 6B, for example, is in contravention with the commonly used rule-of-thumb that all gamma radiation shields will have comparable weight, since the key parameter for shielding is the mass per unit area. For instance, for a cylindrical geometry (as shown in FIG. 6B), if the shield thickness is thin compared to the radius of the nuclear waste canister, then considerable weight can be saved by utilizing a radiation shield with a relatively thin wall thickness (for the tungsten or DU radiation shield) when compared to a shielding material which shield thickness is large compared to the radius of the nuclear waste canister.

Figure 7B:
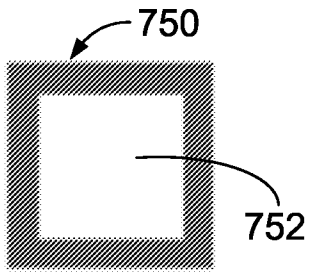
FIGS. 7A and 7B are schematic illustrations of another example implementation of a radiation shield for a hazardous waste canister according to the present disclosure.
Figure 7A:
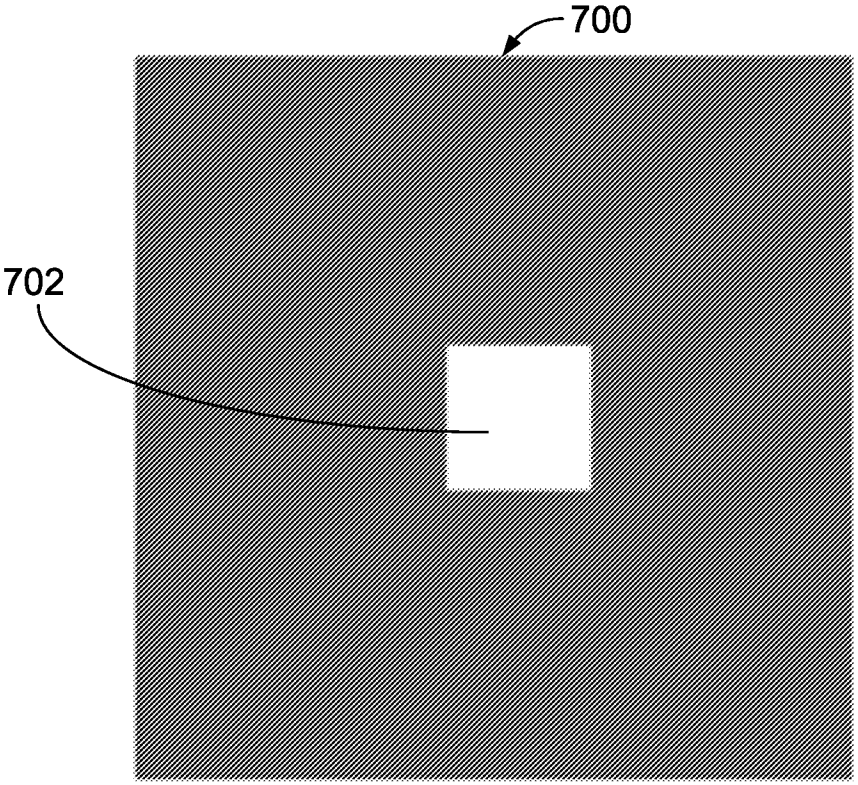

FIGS. 7A and 7B are schematic illustrations (e.g., top views) of another example implementation of a radiation shield for a hazardous waste canister according to the present disclosure. For example, in FIGS. 7A-7B, both the square shield 700 of concrete and the square shield 750 of tungsten (or DU) include a hole 702 and 752, respectively, that is sized to receive a canister containing a SNF assembly for a nuclear reactor. In this example configuration, the ratio of areas is equal, again, 25 (since the difference depends on the square of the thickness ratio). For this geometry, however, the corners of the squares can be rounded. As another example, a spherical geometry may be used for a tungsten or DU radiation shield for a nuclear waste canister. For example, for a radiation shield that surrounds a spherical object emitting gamma rays, the advantage of a tungsten or DU radiation shield over concrete is even greater. Other high density materials can be used for shielding. An example is tungsten carbide, which has a density of 15.8. Lead could be used, which has a density of 11 kg/m3.

The present disclosure also describes a canister and methods for coating the canister to reduce the likelihood that the canister will scratch or otherwise be exposed to corrosion (e.g., crevice corrosion). The coating can be applied to, for example, any one of the hazardous waste canisters 112, 200, 300, or 400 of the present disclosure, as well as other canisters that are in accordance with the present disclosure.

As described, nuclear waste can be disposed of in deep (e.g., human-unoccupiable) drillholes (such as directional drillholes) in stable geologic formations. To obtain a license to dispose of waste in this manner, it is typically required that the waste be isolated not just by the geologic barrier, but also by an engineered barrier (e.g., a sealed canister that holds the waste) so that the nuclear waste can be stored safely for a long period of time (e.g., hundreds or thousands of years) without creating a hazard. The canister is often constructed from a corrosion-resistant alloy (CRA) to prolong its lifetime (e.g., CRAs Alloy 22 or Alloy 625). In the underground environment of a drillhole, particularly if the brine that typically fills the drillhole is reducing (e.g., low in oxygen and other oxygenating compounds), CRA canisters will corrode very slowly, taking thousands of years to be breached.

To resist corrosion, the CRA canisters may include a thin (e.g., less than a micron in depth) passivation film that develops on the canister's surface, preventing corrosive ions from reaching beyond the film and into the canister. The film is typically formed when the CRA canister is exposed to oxygen in the air. If the canister is scratched when underground, the film can be broken, and may not readily reform due to the lack of available oxygen.

In an example implementation of the present disclosure, the canister can be coated with a thin layer of diamond-like carbon (DLC). Such a coating provides both a scratch-resistant layer and an additional corrosion resistant layer. In regulatory language, it provides an additional engineered barrier to the release of the hazardous material. In another example implementation, fused quartz or any other material that is corrosion-resistant but not scratch-resistant may be used in addition to or instead of DLC. In the example where DLC is not used, the canister may be conveyed to the disposal region in a way that avoids scratches or other disruptions to the layer of coating.

In the example implementation where a DLC coating is used, the coating may be tightly bound to the underlying canister material, such as bound at the molecular level. By binding to the canister at a molecule level, no small gap or crevice exists, such that any existing gap is sufficiently narrow that corrosive fluids are slow to enter deeply into the boundary, taking hundreds to thousands of years to do so.

In one example implementation, the coating may be applied to the canister before it is filled with hazardous material. In some aspects, the coating is done over most of the surface of the canister and the canister lid. After the canister is filled with nuclear waste, the lid is welded to the canister. This leaves a small gap in the coating where the lid and the canister meet. This gap can be left with little degradation for at least two reasons. First, the gap can be well away from any region that is likely to be scratched. Second, the bond between the coating and the canister is sufficiently tight that this opening does not result in a pathway that could initiate crevice corrosion. In some aspects, however, a coating is applied over the welded area as well (as explained later).

In another example implementation, the canister may be coated after the waste has been placed inside and the lid has been welded to the canister. Doing this provides a more complete seal, but it may require handling a sealed canister that is potentially more dangerous, and which (in an example implementation where the waste is radioactive) may create a radiation hazard (e.g., from x and/or gamma radiation) in the vicinity of the canister. Moreover, in the example implementation where the canister is holding radioactive waste, the temperature of the canister will rise with time. In some aspects, coating the canister may include either a cooling mechanism, or a short time for vapor deposition, or both, in order to complete the coating before the temperature rises above a workable level (e.g., before coating becomes inefficient or not possible).

In the example implementation where the canister and lid are coated before the canister is filled and sealed, the welded region of the canister may be coated with a new layer of coating after the waste is put in place. In some aspects, both the first, pre-weld coating and the second, post-weld coating may be DLC. In this example, the second layer of coating will bind to the first layer of coating similar to the way that the first layer of coating is bound to the canister, preventing the creation of gaps or crevices between the layers of coating. By applying the second layer of coating after the waste is in place and the canister is welded shut, the coating will protect the entire canister.

The present disclosure describes several implementations. In a first example implementation according to the present disclosure, a hazardous waste canister includes a laminated housing that defines an interior volume sized to receive hazardous waste and is configured to store the hazardous waste in a hazardous waste repository formed within a subterranean formation under a terranean surface; a cap sized to attach to an open end of the laminated housing to seal the hazardous waste within the interior volume; and an end that is attached to the laminated housing to form a closed end of the laminated housing.

In an aspect combinable with the first example implementation, the laminated housing includes an outer wall and an inner wall.

In another aspect combinable with any of the precious aspects of the first example implementation, the outer wall is formed from a corrosion resistant material.

In another aspect combinable with any of the precious aspects of the first example implementation, the corrosion resistant material includes Alloy-22.

In another aspect combinable with any of the precious aspects of the first example implementation, the cap and the end are formed from the corrosion resistant material.

In another aspect combinable with any of the precious aspects of the first example implementation, the inner wall is formed from a high strength material.

In another aspect combinable with any of the precious aspects of the first example implementation, the high strength material includes carbon steel.

In another aspect combinable with any of the precious aspects of the first example implementation, the laminated housing includes an annulus between the inner wall and the outer wall.

Another aspect combinable with any of the precious aspects of the first example implementation further includes a fill material positioned in at least a portion of the annulus.

In another aspect combinable with any of the precious aspects of the first example implementation, the fill material includes a fluid.

In another aspect combinable with any of the precious aspects of the first example implementation, the inner wall includes a solid sheet of material.

In another aspect combinable with any of the precious aspects of the first example implementation, the solid sheet of material is formed into a cylinder.

In another aspect combinable with any of the precious aspects of the first example implementation, the inner wall includes a plurality of hoops or ribs.

In another aspect combinable with any of the precious aspects of the first example implementation, each of the plurality of hoops or ribs forms a circular ring about an axial centerline of the laminated housing.

In another aspect combinable with any of the precious aspects of the first example implementation, the inner wall includes a patterned material that includes a plurality of apertures.

In another aspect combinable with any of the precious aspects of the first example implementation, the patterned material forms a waffle pattern.

In another aspect combinable with any of the precious aspects of the first example implementation, the inner wall is attached to the outer wall at one or more locations.

In another aspect combinable with any of the precious aspects of the first example implementation, the inner wall is integrally formed with the outer wall.

In another aspect combinable with any of the precious aspects of the first example implementation, the hazardous waste includes radioactive waste.

In another aspect combinable with any of the precious aspects of the first example implementation, the radioactive waste includes spent nuclear fuel.

In another aspect combinable with any of the precious aspects of the first example implementation, the interior volume is sized to enclose at least one spent nuclear fuel assembly.

In a second example implementation, a method for adjusting a spent nuclear fuel (SNF) rod includes determining a radial cut location on a length of an SNF rod that includes a plurality of SNF pellets encased in a cladding tube; crimping the cladding tube at or near the radial cut location; cutting through the SNF rod at the radial cut location to form at least two SNF rod portions from the SNF rod; and securing a cap on a cut end of at least one of the SNF rod portions.

In an aspect combinable with the second example implementation, crimping the cladding tube includes crimping the cladding tube at the radial cut location.

In another aspect combinable with any of the precious aspects of the second example implementation, cutting through the SNF rod includes cutting through only the cladding of the SNF rod.

In another aspect combinable with any of the precious aspects of the second example implementation, cutting through the SNF rod includes cutting through the cladding and at least one SNF pellet of the SNF rod.

In another aspect combinable with any of the precious aspects of the second example implementation, the cladding tube includes Zircaloy.

In another aspect combinable with any of the precious aspects of the second example implementation, crimping the cladding tube includes reducing an outer diameter of the cladding tube from a first diameter to a second diameter less than the first diameter.

In another aspect combinable with any of the precious aspects of the second example implementation, the first diameter is about 1 centimeter.

In another aspect combinable with any of the precious aspects of the second example implementation, securing the cap on the cut end of at least one of the SNF rod portions includes securing a respective cap on cut ends of both of the SNF rod portions.

In another aspect combinable with any of the precious aspects of the second example implementation, securing the cap includes welding the cap.

In another aspect combinable with any of the precious aspects of the second example implementation, welding the cap includes spin welding the cap onto the cut end of the cladding tube.

Another aspect combinable with any of the precious aspects of the second example implementation further includes, prior to cutting through the SNF rod at the radial cut location, cooling the SNF rod at the radial cut location.

In another aspect combinable with any of the precious aspects of the second example implementation, cooling the SNF rod at the radial cut location including cooling the cladding tube of the SNF rod to about −157° C. at the radial cut location.

Another aspect combinable with any of the precious aspects of the second example implementation further includes, based on the cooling, at least partially solidifying a portion of krypton fluid within an inner volume of the cladding tube.

In another aspect combinable with any of the precious aspects of the second example implementation, securing the cap includes injecting a material into an inner volume of the cladding tube; and solidifying the material at the cut end to form the cap.

In another aspect combinable with any of the precious aspects of the second example implementation, the material includes a liquid metal.

In another aspect combinable with any of the precious aspects of the second example implementation, the liquid metal includes a material of the cladding tube.

In another aspect combinable with any of the precious aspects of the second example implementation, the liquid metal includes Zircaloy.

Another aspect combinable with any of the precious aspects of the second example implementation further includes forming, by the crimping, a fluid seal at or near the radial cut location.

In another aspect combinable with any of the precious aspects of the second example implementation, the fluid seal prevents a radioactive gas from escaping an inner volume of the cladding tube subsequent to cutting through the SNF rod at the radial cut location.

In another aspect combinable with any of the precious aspects of the second example implementation, a length of at least one of the at least two SNF rod portions is no greater than half of the length of the SNF rod.

In another aspect combinable with any of the precious aspects of the second example implementation, the radial cut location includes a first radial cut location.

Another aspect combinable with any of the precious aspects of the second example implementation further includes determining a second radial cut location on either the length of the SNF rod or one of the at least two SNF rod portions; crimping the cladding tube at or near the second radial cut location; cutting through the either of the SNF rod or the one of the at least two SNF rod portions at the second radial cut location to form at least another two SNF rod portions; and securing another cap on a cut end of at least one of the another two SNF rod portions.

In a third example implementation, a system for adjusting a spent nuclear fuel (SNF) rod is configured to perform any one of the methods of the second example implementation.

In a fourth example implementation according to the present disclosure, a nuclear waste canister radiation shield includes a portion of a non-cementitious shielding material, where the portion includes an inner dimension sized to receive a nuclear waste canister that encloses a radioactive material that emits gamma radiation; and a wall thickness sufficient to prevent a particular percentage of the gamma radiation from emitting from the nuclear waste canister to an outer dimension of the shielding material.

In an aspect combinable with the fourth example implementation, the non-cementitious shielding material includes tungsten or depleted uranium.

In another aspect combinable with any of the precious aspects of the fourth example implementation, the portion of the non-cementitious shielding material is tubular, and each of the inner dimension and the outer dimension includes a diameter.

In another aspect combinable with any of the precious aspects of the fourth example implementation, the radioactive material includes spent nuclear fuel.

In another aspect combinable with any of the precious aspects of the fourth example implementation, the inner dimension is about 10 inches and the outer diameter is about 14 inches.

In another aspect combinable with any of the precious aspects of the fourth example implementation, a length of the portion of the non-cementitious shielding material is about 14 feet.

In another aspect combinable with any of the precious aspects of the fourth example implementation, the portion of the non-cementitious shielding material includes a square-shaped outer shape.

In another aspect combinable with any of the precious aspects of the fourth example implementation, the portion of the non-cementitious shielding material includes a circular or square-shaped hole that extends through the material and is sized to receive the nuclear waste canister.

In another aspect combinable with any of the precious aspects of the fourth example implementation, the inner dimension includes a diameter or a diagonal of about 10 inches.

In another aspect combinable with any of the precious aspects of the fourth example implementation, the particular percentage includes at least 90 percent.

In a fifth example implementation according to the present disclosure, a method includes enclosing a radioactive material that emits gamma radiation in a nuclear waste canister; inserting the nuclear waste canister into a radiation shield, the radiation shield including a non-cementitious shielding material and having an inner dimension sized to receive the nuclear waste canister and a wall defined by a thickness; and preventing a particular percentage of the gamma radiation from emitting from the nuclear waste canister to an outer dimension of the shielding material through the wall of the non-cementitious shielding material.

In an aspect combinable with the fifth example implementation, the non-cementitious shielding material includes tungsten or depleted uranium.

In another aspect combinable with any of the precious aspects of the fifth example implementation, the radiation shield is tubular, and each of the inner dimension and the outer dimension includes a diameter.

In another aspect combinable with any of the precious aspects of the fifth example implementation, the radioactive material includes spent nuclear fuel.

In another aspect combinable with any of the precious aspects of the fifth example implementation, the inner dimension is about 10 inches and the outer diameter is about 14 inches.

In another aspect combinable with any of the precious aspects of the fifth example implementation, a length of the radiation shield is about 14 feet.

In another aspect combinable with any of the precious aspects of the fifth example implementation, the radiation shield includes a square-shaped outer shape.

In another aspect combinable with any of the precious aspects of the fifth example implementation, the radiation shield includes a circular or square-shaped hole that extends through the non-cementitious shielding material and is sized to receive the nuclear waste canister.

In another aspect combinable with any of the precious aspects of the fifth example implementation, the inner dimension includes a diameter or a diagonal of about 10 inches.

In another aspect combinable with any of the precious aspects of the fifth example implementation, the particular percentage includes at least 90 percent.

In a sixth example implementation according to the present disclosure, a nuclear waste canister includes a housing configured to store nuclear waste in a human-unoccupiable directional drillhole in a subterranean formation beneath a terranean surface, the housing defining an open volume sized to fit nuclear waste; a lid sized to fit an open end of the housing to enclose the nuclear waste in the open volume; and a corrosion-resistant coating attached to an exterior surface of the housing.

In an aspect combinable with the sixth example implementation, the housing includes a corrosion-resistant alloy.

In another aspect combinable with any of the precious aspects of the sixth example implementation, the corrosion-resistant alloy includes Alloy 22 or Alloy 625.

In another aspect combinable with any of the precious aspects of the sixth example implementation, the corrosion-resistant coating includes at least one of diamond-like carbon or fused quartz.

In another aspect combinable with any of the precious aspects of the sixth example implementation, the corrosion-resistant coating is attached to the exterior surface of the housing through vapor phase deposition.

In another aspect combinable with any of the precious aspects of the sixth example implementation, the corrosion-resistant coating includes a first layer and a second layer, the first layer attached to the exterior surface of the housing and to an exterior surface of the lid prior to attachment of the lid to the open end of the housing.

In another aspect combinable with any of the precious aspects of the sixth example implementation, the first layer of the coating is tightly bound to the exterior surfaces of the housing and the lid at a molecular level such that a weld between the housing and the lid seals against an opening between the coating and the exteriors.

In another aspect combinable with any of the precious aspects of the sixth example implementation, the second layer of coating is attached to the exterior surface of the housing and to the exterior surface of the lid subsequent to attachment of the lid to the open end of the housing.

In another aspect combinable with any of the precious aspects of the sixth example implementation, the second layer of coating is attached to a weld between the housing and the lid.

In another aspect combinable with any of the precious aspects of the sixth example implementation, the second layer of coating is bound tightly to the first layer of coating at a molecular level, such that there are no small gaps or crevices between the first and second layers of coating.

In another aspect combinable with any of the precious aspects of the sixth example implementation, the coating is attached to the exterior surface of the housing subsequent to attachment of the lid to the open end of the housing.

In another aspect combinable with any of the precious aspects of the sixth example implementation, the housing is cooled prior to or while the coating is being attached.

In another aspect combinable with any of the precious aspects of the sixth example implementation, the coating is bound tightly to the exterior surface of the housing at a molecular level, such that there are no small gaps or crevices between the coating and the exterior surface of the housing.

In a seventh example implementation according to the present disclosure, a method for storing nuclear waste includes inserting nuclear waste into a housing of a nuclear waste canister, where the housing includes an open end through which the nuclear waste is inserted, the housing defining an open volume into which the nuclear waste is inserted; enclosing the nuclear waste in the open volume by attaching a lid to the open end of the housing; and attaching a corrosion-resistant coating to an exterior surface of the housing.

In an aspect combinable with the seventh example implementation, the housing includes a corrosion-resistant alloy.

In another aspect combinable with any of the precious aspects of the seventh example implementation, the corrosion-resistant alloy includes CRA Alloy 22 or Alloy 625.

In another aspect combinable with any of the precious aspects of the seventh example implementation, the corrosion-resistant coating includes at least one of diamond-like carbon or fused quartz.

In another aspect combinable with any of the precious aspects of the seventh example implementation, the attaching includes attaching the corrosion-resistant coating to the exterior surface of the housing through vapor phase deposition.

In another aspect combinable with any of the precious aspects of the seventh example implementation, the attaching includes attaching a first layer of the corrosion-resistant coating to the exterior surface of the housing and to an exterior surface of the lid prior to attachment of the lid to the open end of the housing.

Another aspect combinable with any of the precious aspects of the seventh example implementation further includes tightly binding the first layer of the coating to the exterior surfaces of the housing and the lid at a molecular level such that a weld between the housing and the lid seals against an opening between the coating and the exteriors.

In another aspect combinable with any of the precious aspects of the seventh example implementation, the attaching further includes attaching a second layer of coating to the exterior surfaces of the housing and the lid subsequent to attachment of the lid to the open end of the housing.

In another aspect combinable with any of the precious aspects of the seventh example implementation, the attaching includes attaching the second layer of coating to a weld between the housing and the lid.

Another aspect combinable with any of the precious aspects of the seventh example implementation further includes tightly binding the second layer of coating to the first layer of coating at a molecular level, such that there are no small gaps or crevices between the first and second layers of coating.

In another aspect combinable with any of the precious aspects of the seventh example implementation, the attaching includes attaching the coating to the exterior surface of the housing subsequent to attachment of the lid to the open end of the housing.

Another aspect combinable with any of the precious aspects of the seventh example implementation further includes cooling the housing prior to or while the coating is being attached.

Another aspect combinable with any of the precious aspects of the seventh example implementation further includes tightly binding the coating to the exterior surface of the housing at a molecular level, such that there are no small gaps or crevices between the coating and the exterior surface of the housing.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A hazardous waste canister, comprising:

a housing that defines an inner volume sized to enclose a portion of hazardous waste, the inner volume comprising an excess space between the enclosed portion of hazardous waste and an inner wall surface of the housing;

a cap configured to seal an open end of the housing through which the portion of hazardous waste is inserted into the inner volume; and a pressure balancing material inserted into the inner volume to fill the excess space.

2. The hazardous waste canister of claim 1, wherein the pressure balancing material, when inserted into the inner volume, exerts a pressure on the inner wall surface of the housing to balance a pressure exerted by an underground fluid in a subterranean formation on an outer wall surface of the housing.

3. The hazardous waste canister of claim 1, wherein the pressure balancing material, when inserted into the inner volume, exerts a pressure on the inner wall surface of the housing that is about equal to a pressure exerted by an underground fluid in a subterranean formation on an outer wall surface of the housing.

4. The hazardous waste canister of claim 1, wherein the pressure balancing material comprises a gas at a pressure of about 2200 psi.

5. The hazardous waste canister of claim 1, wherein the pressure balancing material comprises a liquid.

6. The hazardous waste canister of claim 5, wherein the liquid is:

pre-heated to a desired temperature prior to being inserted into the inner volume to fill the excess space; or pre-cooled to a desired temperature prior to being inserted into the inner volume to fill the excess space.

7. The hazardous waste canister of claim 1, wherein the pressure balancing material comprises a solid.

8. The hazardous waste canister of claim 7, wherein the solid comprises a granular or particulate solid.

9. The hazardous waste canister of claim 1, wherein the pressure balancing material comprises a solidifiable liquid.

10. The hazardous waste canister of claim 9, wherein the solidifiable liquid is in a solid form when inserted into the inner volume to fill the excess space, and the solidifiable liquid is in a liquid form in the excess space based on at least one of a temperature in the inner volume or a time duration subsequent to insertion of the solid form into the inner volume to fill the excess space.

11. The hazardous waste canister of claim 9, wherein the solidifiable liquid comprises a fusible alloy.

12. The hazardous waste canister of claim 9, wherein the solidifiable liquid comprises at least one of an epoxy resin, an acrylic resins, a benzoxazines, a vinyl ester, a thermosetting resin, or gallium with a low melting point.

13. The hazardous waste canister of claim 1, wherein the hazardous waste comprises nuclear or radioactive waste.

14. A method, comprising:

enclosing a portion of hazardous waste in an inner volume of a housing of a hazardous waste canister, the inner volume comprising an excess space between the enclosed portion of hazardous waste and an inner wall surface of the housing;

inserting a pressure balancing material into the inner volume to fill the excess space; and sealing an open end of the housing through which the portion of hazardous waste is inserted into the inner volume with a cap.

15. The method of claim 14, wherein the pressure balancing material, when inserted into the inner volume, exerts a pressure on the inner wall surface of the housing to balance a pressure exerted by an underground fluid in a subterranean formation on an outer wall surface of the housing.

16. The method of claim 14, wherein the pressure balancing material, when inserted into the inner volume, exerts a pressure on the inner wall surface of the housing that is about equal to a pressure exerted by an underground fluid in a subterranean formation on an outer wall surface of the housing.

17. The method of claim 14, wherein the pressure balancing material comprises a gas.

18. The method of claim 14, wherein the pressure balancing material comprises a liquid.

19. The method of claim 18, wherein the liquid is:

pre-heated to a desired temperature prior to being inserted into the inner volume to fill the excess space; or pre-cooled to the desired temperature prior to being inserted into the inner volume to fill the excess space.

20. The method of claim 14, wherein the pressure balancing material comprises a solid.

21. The method of claim 20, wherein the solid comprises a granular or particulate solid.

22. The method of claim 14, wherein the pressure balancing material comprises a solidifiable liquid.

23. The method of claim 22, wherein the solidifiable liquid is in a solid form when inserted into the inner volume to fill the excess space, and the solidifiable liquid is in a liquid form in the excess space based on at least one of a temperature in the inner volume or a time duration subsequent to insertion of the solid form into the inner volume to fill the excess space.

24. The method of claim 22, wherein the solidifiable liquid comprises a fusible alloy.

25. The method of claim 22, wherein the solidifiable liquid comprises at least one of an epoxy resin, an acrylic resins, a benzoxazines, a vinyl ester, a thermosetting resin, or low temperature gallium.

26. The method of claim 14, wherein the hazardous waste comprises nuclear or radioactive waste.

* * * * *